US007083255B2

(12) United States Patent
Shibata et al.

(10) Patent No.: US 7,083,255 B2
(45) Date of Patent: Aug. 1, 2006

(54) INK JET PRINTING APPARATUS AND INK JET PRINTING METHOD

(75) Inventors: Tsuyoshi Shibata, Yokohama (JP); Seiichiro Karita, Toda (JP); Hiroyuki Ogino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,982

(22) Filed: Dec. 13, 2004

(65) Prior Publication Data

US 2005/0128229 A1 Jun. 16, 2005

(30) Foreign Application Priority Data

Dec. 15, 2003 (JP) ..... 2003-417363

(51) Int. Cl.
*B41J 2/21* (2006.01)
*B41J 29/38* (2006.01)

(52) U.S. Cl. ..... 347/40; 347/9; 347/12

(58) Field of Classification Search ..... None
See application file for complete search history.

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
5,412,410 A 5/1995 Rezanka ..... 347/15
5,933,162 A 8/1999 Shioya

FOREIGN PATENT DOCUMENTS

JP 59-123670 7/1984
JP 59-138461 8/1984
JP 3249627 11/2001

*Primary Examiner*—Thinh Nguyen
(74) *Attorney, Agent, or Firm*—Fitzpatrick, Cella, Harper & Scinto

(57) ABSTRACT

This invention provides an ink jet printing apparatus of a low cost construction having a plurality of print head units arranged at equal intervals and capable of forming a high quality image at high speed. A plurality of print head units each having a plurality of ink ejection nozzles are arranged side by side in the scan direction. An ink volume applied to a unit area of a print medium by at least the print head unit situated most upstream in the scan direction is set greater than those applied by the other print head units.

15 Claims, 22 Drawing Sheets

54

| | | | | | | | |
|---|---|---|---|---|---|---|---|
| 1 | a | 1 | a | 1 | a | 1 | a |
| b | 2 | b | 2 | b | 2 | b | 2 |
| 3 | c | 3 | c | 3 | c | 3 | c |
| d | 4 | d | 4 | d | 4 | d | 4 |
| 5 | e | 5 | e | 5 | e | 5 | e |
| f | 6 | f | 6 | f | 6 | f | 6 |
| 7 | g | 7 | g | 7 | g | 7 | g |
| h | 8 | h | 8 | h | 8 | h | 8 |

. . .

| | | | | | | | |
|---|---|---|---|---|---|---|---|
| A1 | C1 | A1 | C1 | A1 | C1 | A1 | C1 |
| B1 | D1 | B1 | D1 | B1 | D1 | B1 | D1 |
| C2 | A2 | C2 | A2 | C2 | A2 | C2 | A2 |
| D2 | B2 | D2 | B2 | D2 | B2 | D2 | B2 |
| A3 | C3 | A3 | C3 | A3 | C3 | A3 | C3 |
| B3 | D3 | B3 | D3 | B3 | D3 | B3 | D3 |
| C4 | A4 | C4 | A4 | C4 | A4 | C4 | A4 |
| D4 | B4 | D4 | B4 | D4 | B4 | D4 | B4 |

11-2

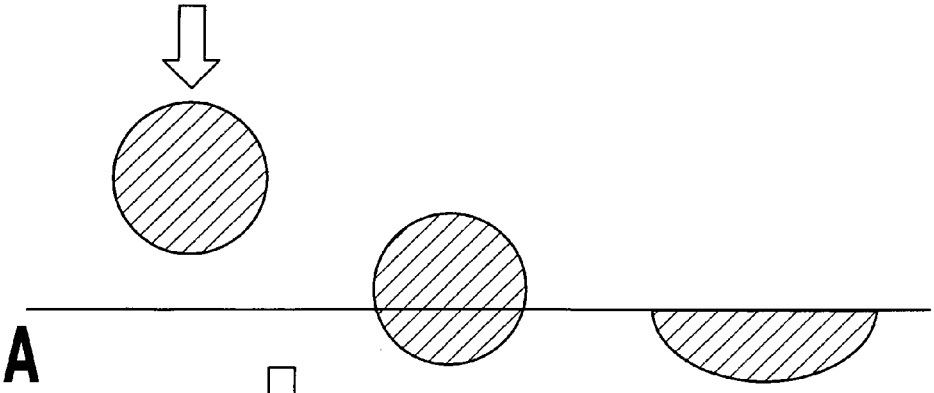
FIG.19A
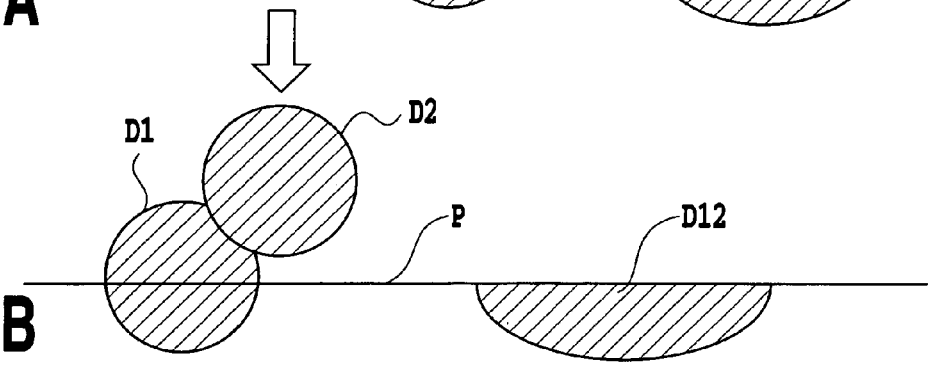
FIG.19B
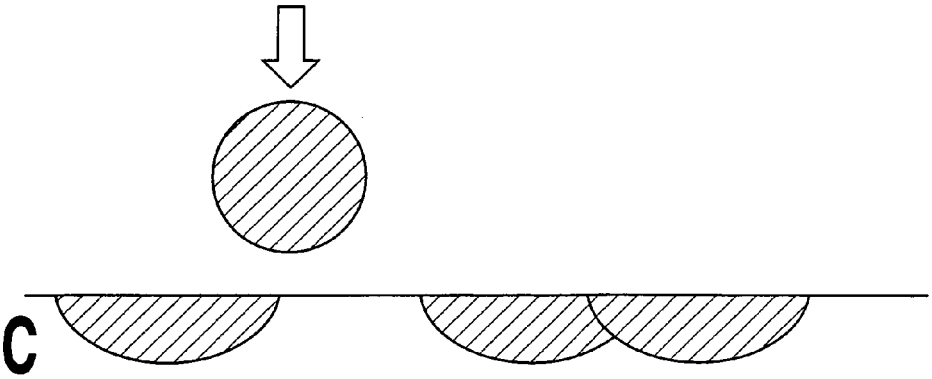
FIG.19C
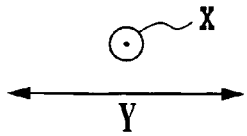

INK JET PRINTING APPARATUS AND INK JET PRINTING METHOD

BACKGROUND OF THE INVENTION

1. Field of the Invention

The present invention relates to an ink jet printing apparatus and printing method for forming an image on a print medium by moving the print medium relative to a print head having nozzles densely arrayed therein to eject ink containing a colorant More specifically, the present invention relates to an ink jet printing apparatus and an ink jet printing method using an elongate print head which has a plurality of nozzle groups each made up of an array of nozzles arranged in a direction crossing a direction in which the print head and medium move relatively to each other. Particularly, this invention relates to an ink jet printing method, an ink jet printing apparatus and a print head suited for a so-called one-pass printing in which the elongate print head is scanned only once over a print area to complete a printed image.

This invention is applicable to all devices that print on print mediums made of paper, cloth, nonwoven fabric, OHP sheets and metal materials. Examples of applicable devices include office equipment such as printers, copying machines and facsimiles, and industrial manufacturing equipment.

2. Description of the Related Art

As information processing equipment, such as copying machines, word processors and computers, and communication equipment make technological advances, ink jet printing apparatus that print digital images by an ink jet method are becoming increasingly widespread as an image recording device for these equipment. One of the ink jet printing apparatus is known to use a print head that has a plurality of print elements (also referred to as nozzles) densely arrayed therein to increase a print speed. Further, in recent years there is a growing demand for a capability to print color images and, in response to this demand, printing apparatus that use a plurality of print heads for ejecting color inks are in common use.

What is meant by a nozzle as referred to in this specification and the scope of the claims is one that includes an ink ejection opening to eject ink supplied into a common ink chamber in the print head, an ink path to introduce ink supplied into the common ink chamber to the ink ejection opening, and an ejection energy generation element to eject ink supplied to the ink path from the ink ejection opening.

Generally, an ink jet printing apparatus ejects ink or recording liquid in the form of flying ink droplets onto a variety of print mediums made of such material as paper to form an image thereon. Since the ink jet printing apparatus adopts a non-contact system by which the print head does not contact the print medium, the printing can be performed with low noise. Another advantage is that the print resolution and the print speed can be increased by increasing the nozzle density. Further, the ink jet printing apparatus does not need special processing, such as development and fixing, even for such print mediums as plain paper. All these advantages allow for the printing of images at low cost and at high quality and therefore the ink jet printing apparatus is finding an ever widening range of applications. An on-demand type ink jet printing apparatus in particular has the advantages of being able to be easily upgraded to print color images and be reduced in size and simplified in construction and thus its demand is expected to expand in the future. As a demand for a capability to print color images grows, so does the need for higher print quality and faster print speed.

With a remarkable advance in recent years in the technology to form nozzles with high density, a fabrication of a high-density, elongate print head has come to be realized. An elongate print head having nozzles arrayed at high density is generally called a full-multi type elongate print head. An ink jet printing apparatus using such an elongate print head has been proposed and implemented which completes a printed image in one printing scan over a wide print area corresponding to the elongate print head. This ink jet printing apparatus can meet requirements for both print speed and print quality. Because of these advantages, further efforts for development are being made on this type of printing apparatus.

However, the ink jet printing apparatus using the elongate print head with high-density nozzles has the following problems.

First, in the above system if an image in a print area is to be completed in one printing scan (one pass) or in a small number of passes, ink droplets ejected from the nozzles of print head units need to be absorbed and fixed in the print medium in a short period of time. This requires a bulky heat and dry means for the print medium or a means to reduce a volume of ink used for printing. This in turn increases cost and reduces the print density or pixel density, degrading the quality of the printed image.

Second, if the nozzles are arrayed at high density in a single line, ink droplets ejected from the adjoining nozzles may merge together on the print medium into an inappropriate shape. When an image to be printed has a high duty, the ink that failed to be absorbed in the print medium may remain on the print medium in a liquid state, degrading the print quality

SUMMARY OF THE INVENTION

The present invention has been accomplished to overcome the problems experienced with conventional technologies and it is an object of this invention to provide an ink jet printing apparatus of an inexpensive construction having a plurality of nozzle groups arranged at equal intervals and capable of forming a high quality image with no density variations at high speed.

To achieve the above objective, a first aspect of this invention provides an ink jet printing apparatus for forming an image on a print medium by moving a print head having a plurality of nozzle groups relative to the print medium in a main scan direction as the nozzle groups eject ink from their ink ejection nozzles according to print information, the nozzle groups each having a plurality of ink ejection nozzles and being arranged side by side in the main scan direction; wherein each of the nozzle groups has at least one nozzle array, the nozzle array having a plurality of nozzles arrayed in a predetermined array direction crossing the main scan direction; wherein the ink jet printing apparatus includes an ejection volume setting means which sets ink volumes applied to a unit area of the print medium by the nozzle groups in such a way that an ink volume per unit area applied by at least the nozzle group situated most upstream in the main scan direction is greater than those applied by the other nozzle groups.

A second aspect of this invention provides an ink jet printing method for forming an image on a print medium by moving a print head having a plurality of nozzle groups relative to the print medium in a main scan direction as the nozzle groups eject ink from their ink ejection nozzles according to print information, the nozzle groups each having a plurality of ink ejection nozzles and being arranged side by side in the main scan direction; wherein each of the nozzle groups has at least one nozzle array, the nozzle array having a plurality of nozzles arrayed in a predetermined array direction crossing the main scan direction; wherein ink volumes applied to a unit area of the print medium by the nozzle groups are set in such a way that an ink volume per unit area applied by at least the nozzle group situated most upstream in the main scan direction is greater than those applied by the other nozzle groups.

This invention can print a high quality image with no density variations at high speed by adopting an inexpensive construction that has a plurality of nozzle groups arranged at equal intervals. Thus, problems experienced with conventional technologies in a 1-pass printing system using an elongate print head used for high-speed printing can be eliminated. That is, in the conventional 1-pass printing, a large enough landing time difference between successively applied dots and between adjoining dots cannot be secured, resulting in ink dots degrading locally, which in turn leads to an overall image quality degradation. This problem is completely eliminated, allowing for a high quality image printing at high speed. Further, since there is no need to increase the nozzle group distances greatly, the printing apparatus can be prevented from becoming large.

When forming a color image using a plurality of color inks, ink droplets of different colors land on a print medium partly overlapping each other. In that case, by having print data with a high print duty printed by a nozzle group situated upstream, the ink absorption time can be shortened. This allows for a high speed printing. When, for example, a photographic image is printed, nozzle groups that eject those color inks with high duties, such as cyan, magenta or yellow ink, are located on the upstream side in the order of printing. With this arrangement, when a plurality of color inks are applied to the print medium overlappingly, the inks can be absorbed efficiently in the print medium according to the ink absorption characteristics of the print medium during the high speed printing. This in turn enables successive dots and adjoining dots to be formed properly, producing a high quality color image.

Further, Japanese Patent No. 03249627 discloses a construction in which, in a printing method called a multipass printing that completes an image in a plurality of printing scans, print dot data is distributed between different passes such that the number of dots printed in a preceding printing scan is larger than those of the subsequent printing scans.

This invention is characterized in that, in a printing apparatus using a line head, a nozzle group ejecting a color ink with a high print duty is situated on the upstream side of the print medium feed direction.

The above and other objects, effects, features and advantages of the present invention will become more apparent from the following description of embodiments thereof taken in conjunction with the accompanying drawings.

BRIEF DESCRIPTION OF THE DRAWINGS

FIG. 19A illustrates a process of ink droplet landing on a print medium, showing one of ink droplets ejected from nozzles landing on the print medium;

FIG. 19B illustrates a process of ink droplet landing on a print medium, showing how an adjoining ink droplet lands on the print medium with a relatively short time difference;

FIG. 19C illustrates a process of ink droplet landing on a print medium, showing how an adjoining ink droplet lands on the print medium with a relatively long time difference;

DETAILED DESCRIPTION OF PREFERRED EMBODIMENTS

Now, preferred embodiments of this invention will be described in detail by referring to the accompanying drawings.

Figure 1:
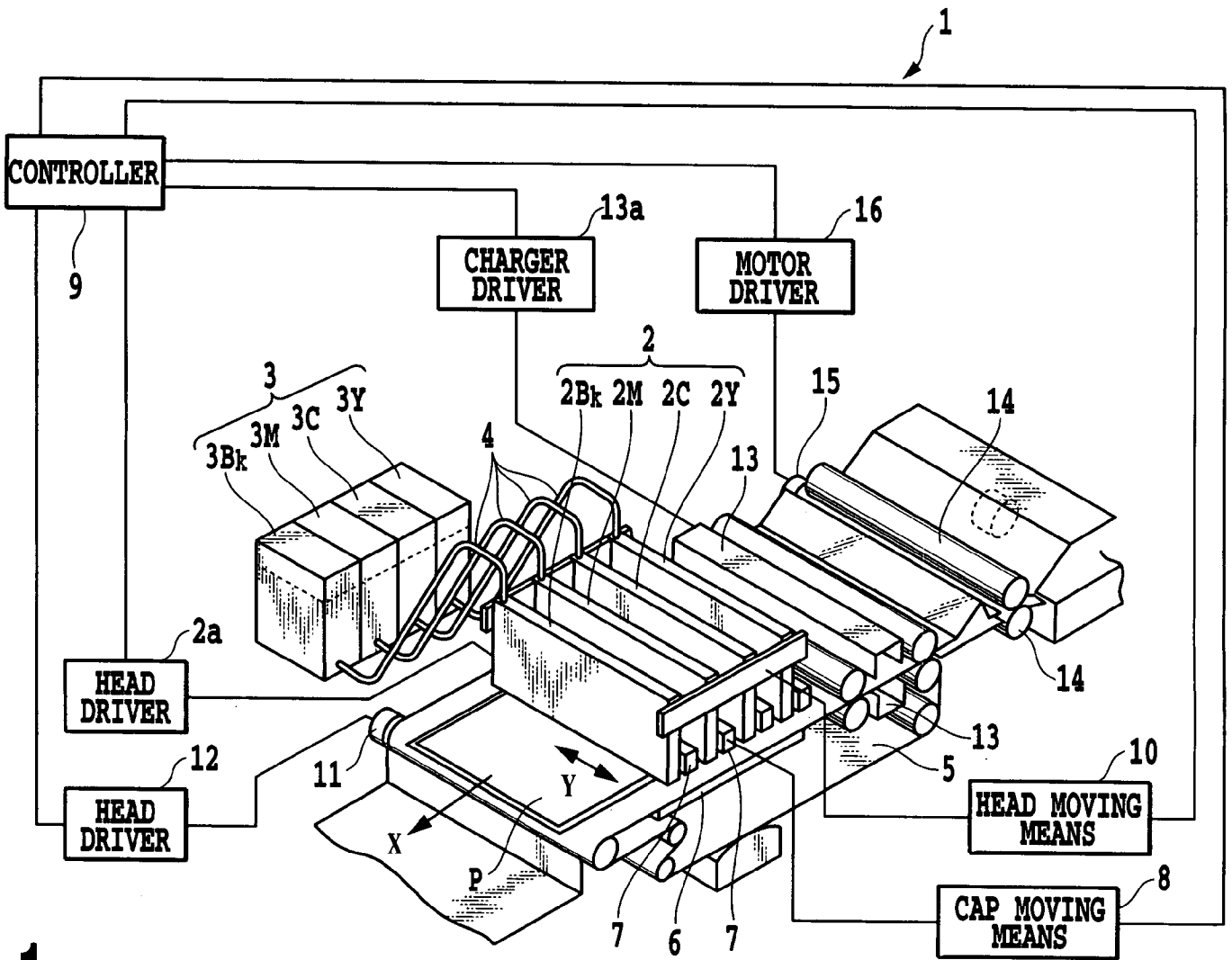
FIG. 1 is a schematic diagram showing a conceptual construction of an ink jet printing apparatus applied to an embodiment of this invention.
Figure 2:
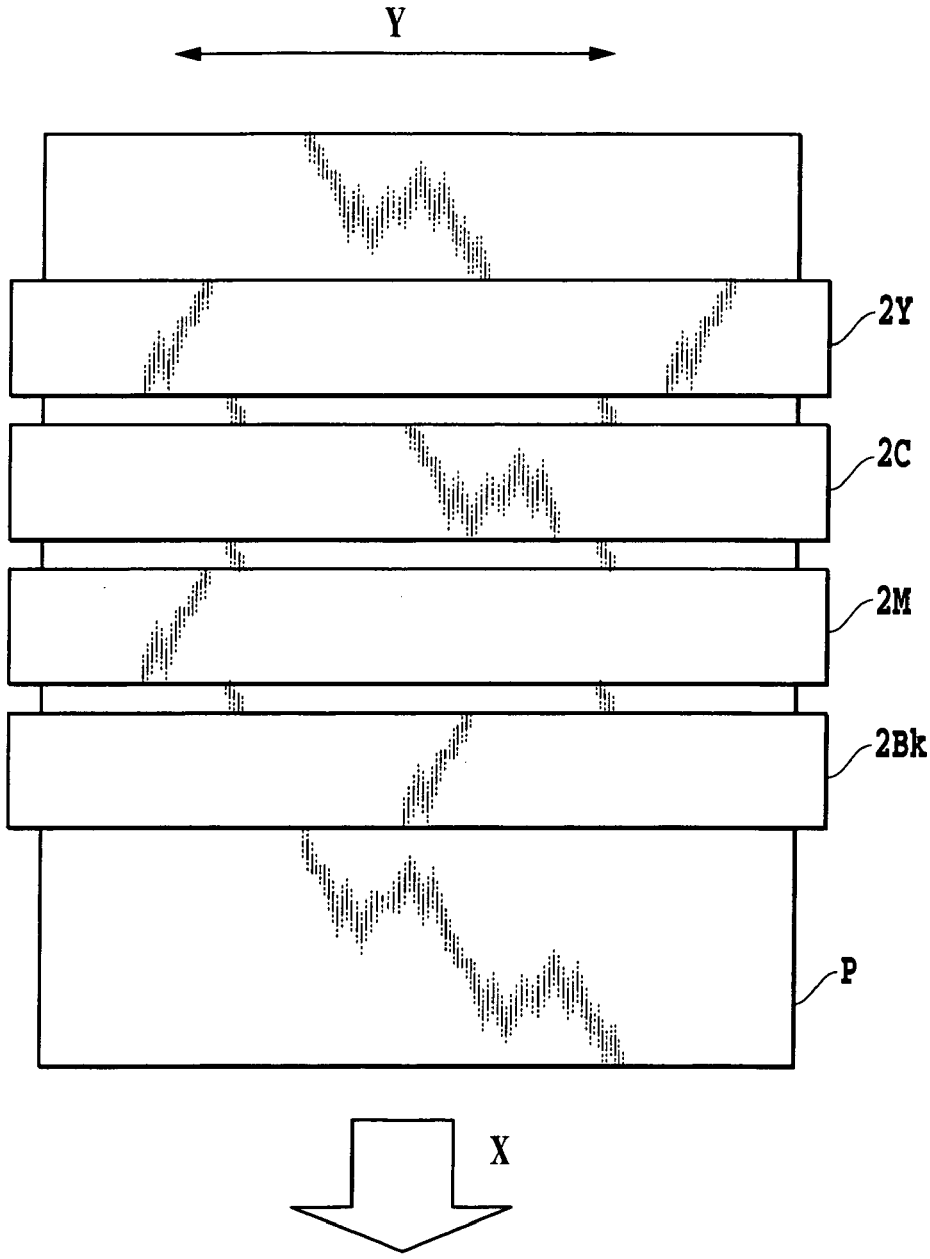
FIG. 2 is a plan view schematically showing an arrangement of print heads.

FIG. 1 is a schematic diagram showing a conceptual construction of an ink jet printing apparatus applied to embodiments of this invention. FIG. 2 is a plan view schematically showing an arrangement of print heads.

An ink jet printing apparatus 1 of this embodiment is a color ink jet printing apparatus having a plurality of parallel 1y arranged elongate print heads 2Y, 2C, 2M, 2BK extending in a direction perpendicular to a direction of feed of a print medium. Denoted 2Y is a print head to eject a yellow ink, 2M a print head to eject a magenta ink, 2C a print head to eject a cyan ink, and 2Bk a print head to eject a black ink. These print heads have almost the same construction and thus, unless otherwise specifically stated, they are generally described as a print head 2.

These print heads 2 are connected to four ink tanks 3Y, 3C, 3M, 3Bk (hereinafter referred to generally as an ink tank 3) containing yellow, magenta, cyan and black inks, respectively, through connecting tubes 4. These ink tanks 3 are removable from the connecting tubes 4 for replacement.

The print heads 2 can be moved vertically toward and away from a platen 6 by a head moving means 10 dedicated for recovery processing that is controlled by a controller 9. The print heads 2 are arranged at a predetermined interval in a transport direction of an endless transport belt 5 in such a way that they face the platen 6 with the transport belt 5 interposed therebetween. The print head 2 is formed with ink ejection openings, a common ink chamber to which an ink is supplied from the ink tank 3, and ink paths for introducing the ink from the common ink chamber to individual ink ejection openings. In each ink path there is provided a nozzle that has an electrothermal transducer (heater) as an ejection energy generation means to generate thermal energy for ejecting the ink supplied. The heaters are electrically connected to a controller 9 through a head driver 2*a*. The energizing and de-energizing of the heaters is controlled according to an on/off signal (ejection/non-ejection signal) sent from the controller.

By the side of each print head 2 head caps 7 are arranged at the same intervals as, but shifted half a pitch from, the print heads to discharge viscous ink from the ink paths prior to performing a printing operation on a print medium P to recover an ejection performance of the print heads The head caps 7 can be moved to directly under the print heads 2 by a cap moving means 8 controlled by the controller 9 to receive waste ink discharged from the ink ejection openings.

The transport belt 5 for feeding the print medium P is wound around drive rollers connected to a belt drive motor 11, which is driven by a motor driver 12 connected to the controller 9. Upstream of the transport belt 5 is installed a charger 13 that charges the transport belt 5 to bring the print medium P into intimate contact with the transport belt 5. The charger 13 is energized/de-energized by a charger driver 13*a* connected to the controller 9. A pair of feed rollers 14, 14 to feed the print medium P onto the transport belt 5 is connected to a feed motor 15 that drives the feed rollers 14, 14. The feed motor 15 is operated by a motor driver 16 connected to the controller 9.

In performing a printing operation on the print medium P, the print heads 2 are first lifted away from the platen 6. Next, the head caps 7 are moved to directly under the individual print heads 2 to perform the recovery operation and then returned to the standby position. After this, the print heads 2 are lowered toward the platen until they reach the print position. Then, the charger 13 is energized, and at the same time the transport belt 5 is driven, the print medium P is fed by the feed rollers 14, 14 onto the transport belt, and the print heads 2 are activated to form a color image on the print medium P.

Figure 3:
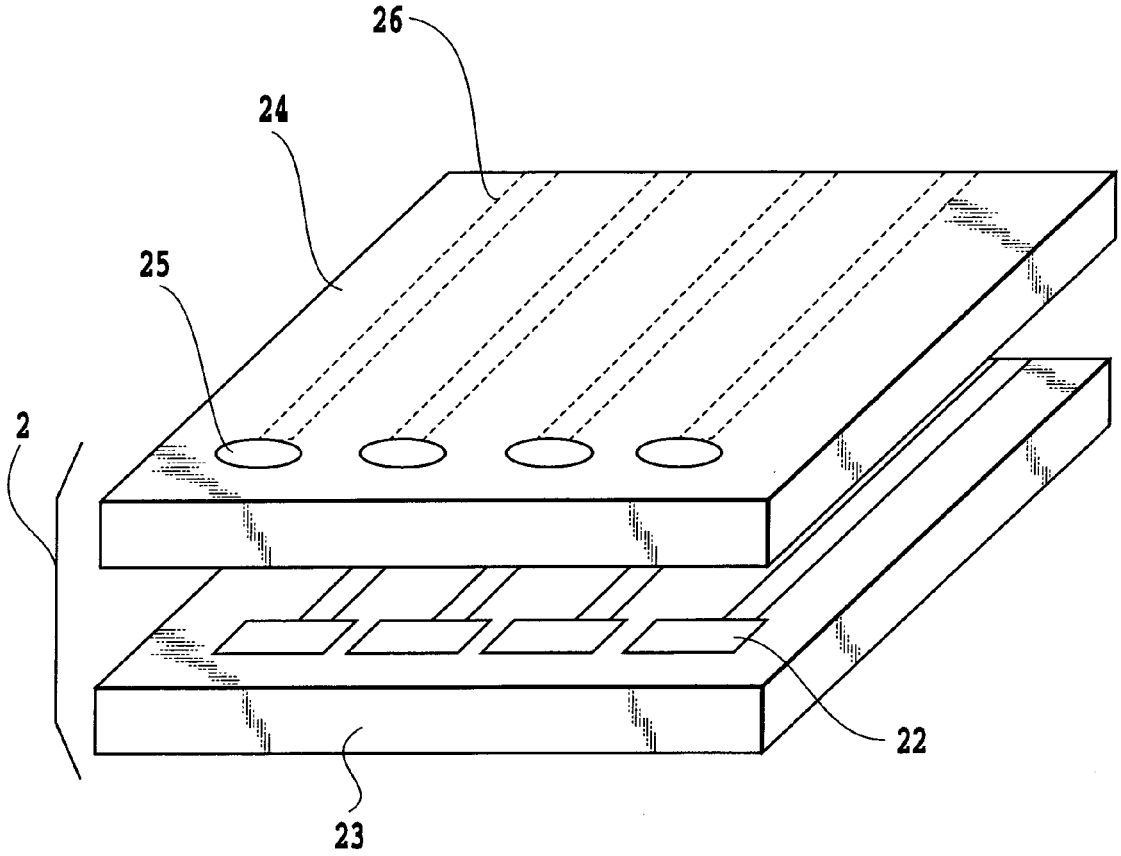
FIG. 3 is an exploded perspective view showing an internal construction of the print head in the embodiment of this invention.

Next, referring to FIG. 3, the inner construction of the print head 2 will be described.

In the figure, the ink jet print head 2 has a heater board 23 formed with a plurality of heaters 22 for heating ink and a top plate 24 mounted on the heater board 23. The top plate 24 is formed with a plurality of ink ejection openings 25. Behind each of the ink ejection openings 25 a tunnel-like ink path 26 is formed which communicates with the corresponding ink ejection opening 25. The ink paths 26 are commonly connected at their rear end to an ink chamber. The ink chamber is supplied an ink from the associated ink tank 3. The ink supplied to the ink chamber is then fed to individual ink paths 26.

The heater board 23 and the top plate 24 are assembled so that the heaters 22 align with the corresponding ink paths 26. The heaters 22, although only four of them are shown in FIG. 3, are assigned one to each ink path 26. In the assembled print head, when a predetermined drive pulse is applied to the heaters 22, ink over each heater 22 boils to produce a bubble which, as its volume expands, expels an ink droplet from the ink ejection opening 25. The ink jet printing system applicable to this invention is not limited to a so-called bubble jet (registered tradename) system that uses the heaters as shown in FIG. 1 and FIG. 2. For example, in the case of a continuous system that continuously ejects ink for drop formation, a charge control type and a diffusion control type may be applied. In the case of an on-demand system that ejects ink droplets on demand, a pressure control type that ejects ink drops from ink ejection openings by mechanical vibrations produced by a piezoelectric oscillation device can be applied.

Figure 4:
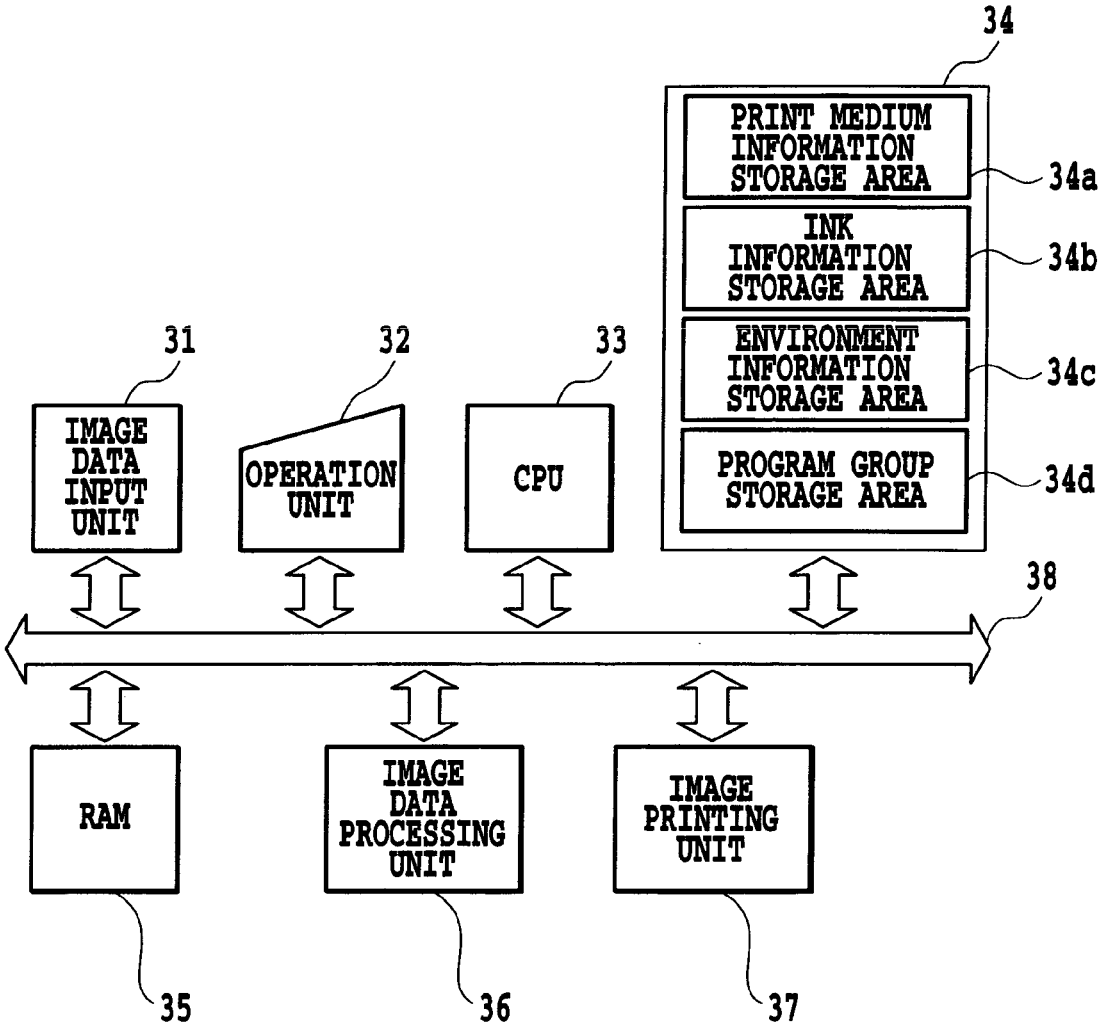
FIG. 4 is a block diagram showing an example configuration of a control system in the ink jet printing apparatus of this invention.

FIG. 4 is a block diagram showing an example configuration of a control system in the ink jet printing apparatus of this invention In FIG. 4, denoted 31 is an image data input unit to enter multi-valued image data from image input devices such as scanner and digital camera and multi-valued image data stored in a hard disk of a personal computer, 32 an operation unit having a variety of keys to set parameters and instruct a start of printing, and 33 a CPU as a control means to control the entire printing apparatus according to various programs in storage media. Reference number 34 represents a storage means for storing a variety of data. The storage means 34 has a print medium information storage area 34*a* to store information about the kind of print medium, an ink information storage area 34*b* to store information about ink used for printing, an environment information storage area 34*c* to store information on the environment at time of printing such as temperature and humidity, and a control program group storage area 34*d*. A RAM 35 is used as a work area for various programs in the storage means 34, as a temporary save area for processing errors, and as a work area for processing an image. In this embodiment all operations are performed according to the programs in the storage means. As the storage means 34 to store the programs, ROM, FD, CD-ROM, HD, memory card and magnetooptical disc may be used. The RAM 35 may also be used to copy various tables in the storage means 34 and then change the contents of the tables so that the image processing can be performed by referring to the modified tables.

Denoted 36 is an image data processing unit which quantizes input multi-valued image data into N-valued image data for each pixel and generates an ejection pattern according to quantized grayscale values "K" of individual pixels. The image data processing unit 36 transforms input multi-valued image data into N-valued image data and then creates an ejection pattern that matches the grayscale values "K". For example, if 8-bit multi-valued image data (representing 256 grayscale levels) is supplied to the image data input unit 31, the image data processing unit 36 transforms grayscale values of the image data to be output into K values. While a multi-value error diffusion method is used In the process of transforming input grayscale image data to K values in this example any desired half-tone processing method, such as average density storage method and dither matrix method, may be employed. Based on image density information, the transform-to-K-value processing is repeated for all pixels to generate binary drive signals dictating whether individual nozzles are to eject or not eject ink for each pixel.

Denoted 37 is an image printing unit 37 to eject ink according to the ejection pattern generated by the image data processing unit 36 to form a dot image on a print medium. Designated 38 is a bus line to transfer an address signal, data and control signal in the printing apparatus.

Referring to FIG. 5A to FIG. 16, an arrangement of nozzles in a print head of this invention and a state of dots formed on a print medium will be described. To clarify features of preferred embodiments of this invention, an explanation will be given first to related technologies of this invention by referring to FIG. 5A to FIG. 14 and then to an arrangement of nozzles in the print head of this embodiment and a printing operation.

Related Technologies of this Invention

Figure 5A:
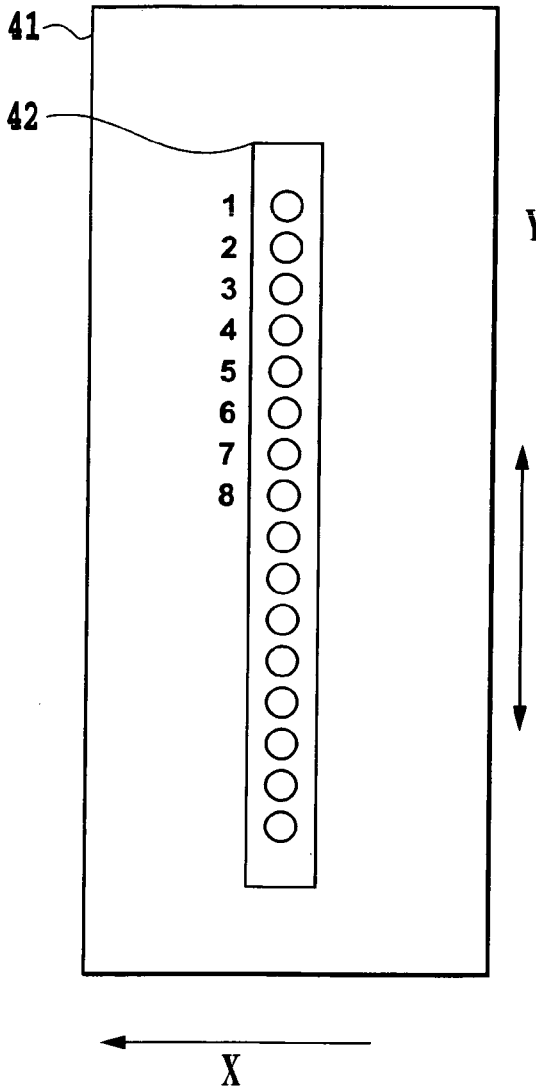
FIG. 5A is a schematic diagram showing an example nozzle array in an elongate print head according to a related technology of this invention.

FIG. 5A shows an example of a print head according to a related technology of this invention. The print head shown here is an elongate print head used in a full-line type ink jet printing apparatus.

Figure 5B:
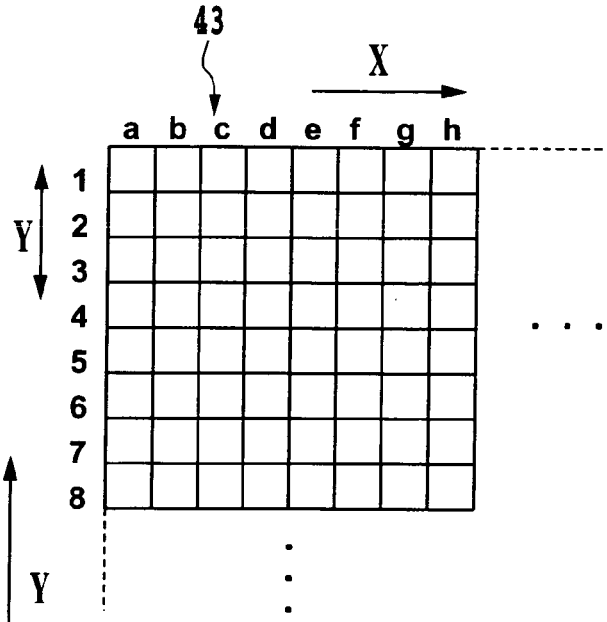
FIG. 5B illustrates an image matrix printed using the print head of FIG. 5A.

In FIG. 5A, denoted 41 is a print head having a nozzle group 42 made up of a single array of 1,280 nozzles arrayed nearly in a straight line at an interval of 1,200 dpi (about 21.1 μm). In the figure, X represents a direction in which the print head 41 moves relative to a print medium. In this embodiment, the print head is fixedly secured to a printing apparatus body as shown in FIG. 1 and the print medium is moved in a direction opposite the X direction (main scan direction). With the print head and the print medium moved relative to each other in this manner, ink droplets successively land on a print matrix 43 on the print medium as shown in FIG. 5B.

More specifically, ink droplets ejected from nozzle No. 1 successively land on arrays a, b, c, . . . in a print raster No. 1 of the print matrix 43; and ink droplets ejected from nozzle No. 2 successively land on arrays a, b, c, . . . in print raster No. 2 to form an image Each square in the print matrix 43 represents a pixel, and in the following description the position of each pixel in the print matrix is represented by a combination of a raster No. 1, 2, 3, . . . and an array No. a, b, c, . . . , for example, (1, a) and (2, c).

When a printing operation is performed continuously in the raster direction, a time difference between ink droplets successively landing on a pixel (1, a) and a pixel (1, b) on the print matrix 43 depends on a time difference between two successive ink droplets being ejected from the same nozzle, i.e., a drive frequency of the nozzle. For example, if the printing is done by continuously ejecting ink droplets at 10 kHz, the ink droplets land on the two pixels with a time difference of 0.1 msec. At a pixel (1, a) and a pixel (2, a) ink droplets land almost simultaneously and thus the landing time difference between these two pixels is almost zero. Between pixels (1, a) and (2, b) there is a time difference of 0.1 msec. Therefore, when the printing is done to fill all pixels of the print matrix 43 with dots in one pass by using the print head 42 of FIG. 5A (solid printing), all dots are printed within 0.1 msec of the adjoining dots, or any adjoining dots are printed with a landing time difference of 0.1 msec or less.

At this time, if a diameter of a dot formed by an ejected ink droplet is larger than one side of a pixel in the print matrix 43 (in this case the pixel size is 21.2 μm square), the dot contacts at least dots that adjoin it in the raster direction and the array direction. For instance, a dot formed at a pixel (1, a) contacts a dot formed at a pixel (1, b) and also a dot formed at a pixel (2, a). If the diameter of a dot formed is larger than a diagonal length of a pixel, not only does the dot contact the adjoining dots in the raster and array direction, it also contacts dots that adjoin it in the diagonal direction of the print matrix 43. That is, the dot at (1, a) also overlaps a pixel (2, b).

Also, if, depending on a landing precision, a droplet fails to land so that the center of a dot formed matches an ideal position on the print medium (i.e., a center of each pixel on the print matrix), there is an increased possibility of the dot contacting the adjoining dots.

Figure 18A:
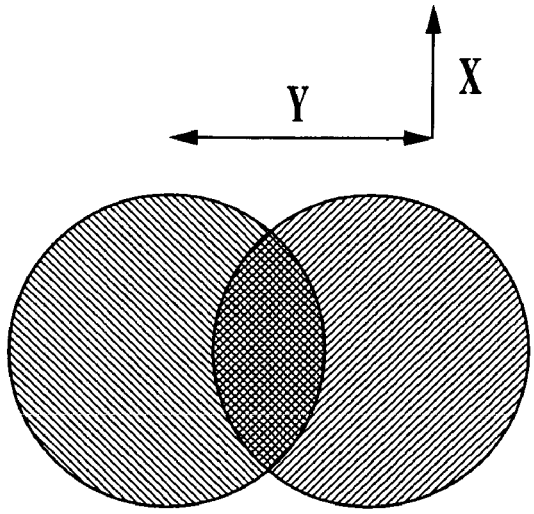
FIGS. 18A, 18B and 18C illustrate merged dots, each formed by two ink droplets ejected from adjoining nozzles in the print head.
Figure 18B:
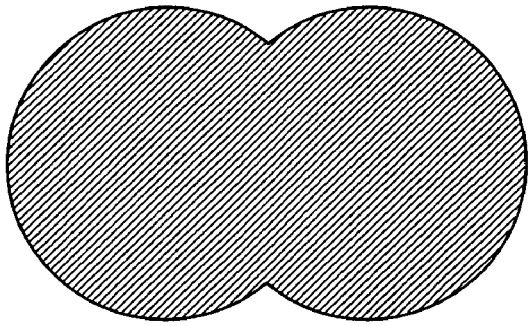
Figure 18C:
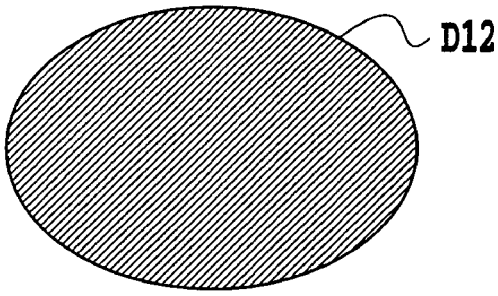

When an image is attempted to be completed in one pass by using an elongate print head that has nozzles arrayed nearly in a straight line at high density, as in the print head 41 of FIG. 5A, the landing time difference between adjoining dots necessarily becomes short as the print speed increases, which in turn enhances the possibility of the adjoining dots coming into contact with each other as described above. In that case, as shown in FIG. 19B, an adjoining droplet D2 may land before a preceding ink droplet D1 that already landed on a print medium P is absorbed completely in the print medium. If this happens, the preceding ink droplet D1 and the subsequent ink droplet D2 may merge together on the print medium P (see D12 in FIG. 19B) forming into an undesirable shape as shown in FIG. 18C (two dots combining into a contracted oval shape). It is desired that two adjoining dots combine to form a gourd-shaped merged dot, when viewed from above, as shown in FIG. 18A and FIG. 18B.

This problem is not likely to occur with an interlace printing or a multipass printing performed by a serial type ink jet printing apparatus but is characteristic of a full-line type ink jet printing apparatus that performs high-speed printing. That is, in the full-line type ink jet printing apparatus intended for high-speed printing a speed at which an ink droplet is absorbed in a print medium may not be able to catch up with the print speed, which greatly contributes to a degradation of image quality The applicant of this invention therefore focused on the time it takes for the ink to be absorbed in the print medium and proposed the following technology.

Figure 6:
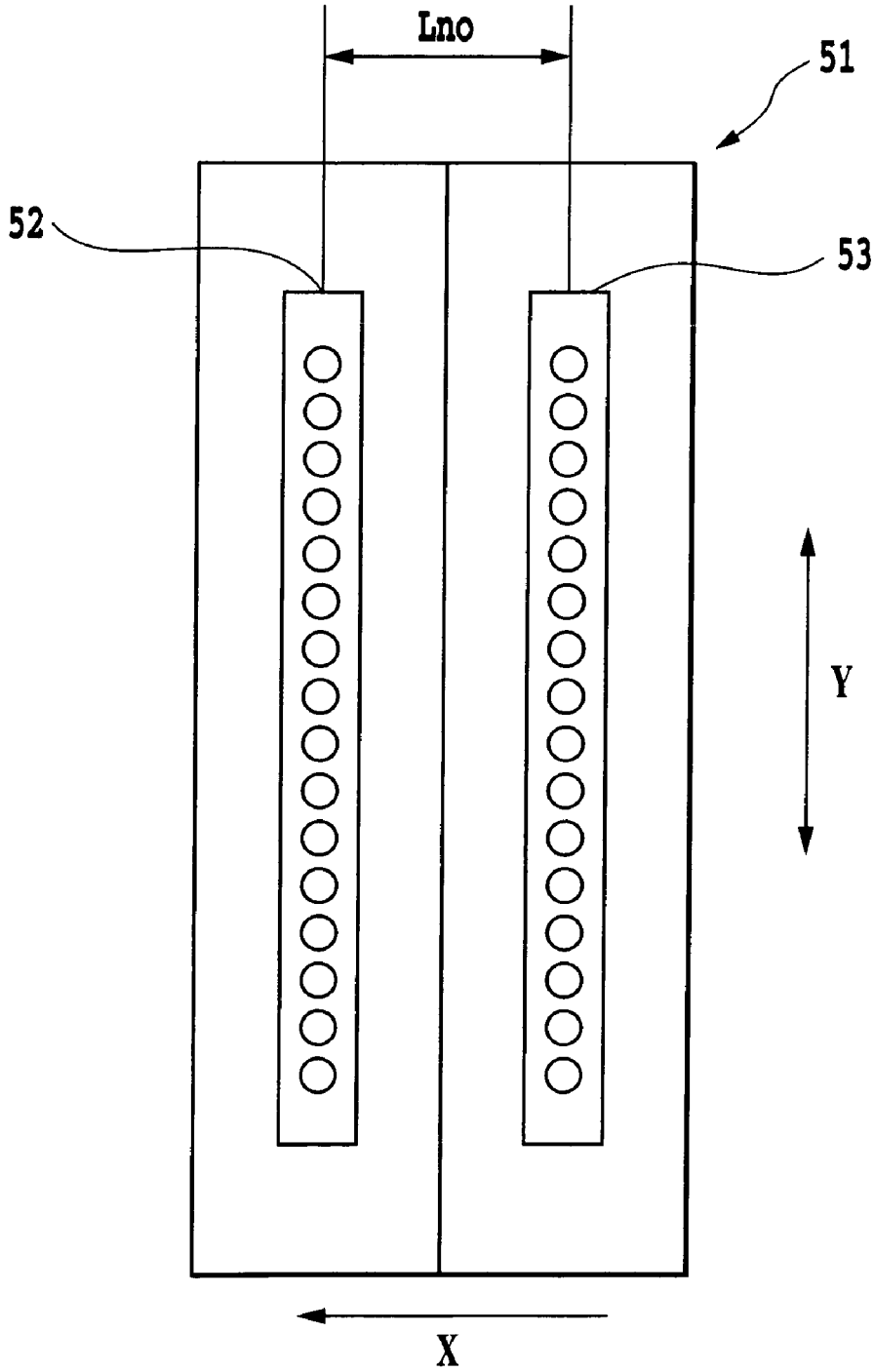
FIG. 6 is a schematic diagram showing another example nozzle array in the elongate print head according to the related technology of this invention.

FIG. 6 schematically shows a print head 51 of another related technology of this invention. In the figure, reference numerals 52 and 53 represent nozzle groups making up the print head 51. Each of the nozzle groups has 640 nozzles arrayed almost in a straight line at an interval of 42.5 μm, and a distance between the two nozzle groups 52 and 53 is set at Lno. X represents a main scan direction which is opposite the print medium moving direction and Y represents a direction, perpendicular to the main scan direction, in which the nozzles in each nozzle group are arrayed.

Figures 7A, 7B:
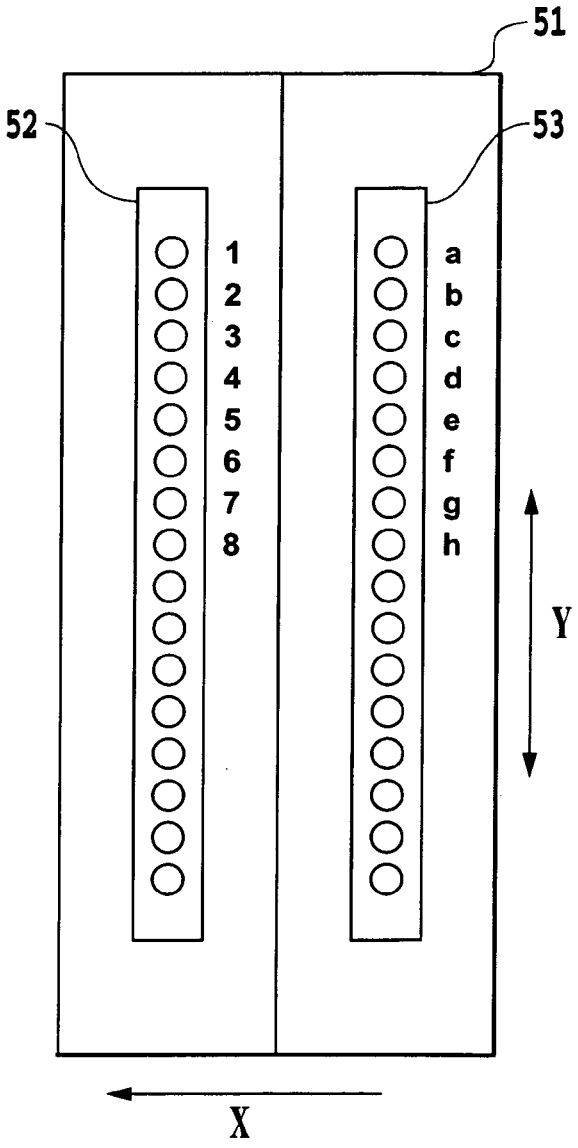
FIG. 7A is a schematic diagram showing still another example nozzle array in the elongate print head according to the related technology of this invention.
FIG. 7B illustrates an image matrix printed using the print head of FIG. 7A.

FIG. 7A and FIG. 7B show at which pixel of a print matrix 54 an ink droplet ejected from each nozzle of the print head 41 of FIG. 6 lands. That is, ink droplets ejected from the individual nozzle Nos. of the print head 51 shown in FIG. 7A are made to land on the print matrix 54 at pixels marked with the corresponding Nos. An ink droplet ejected from a nozzle No. 1 in the nozzle group 52 lands on a pixel No. 1 in the print matrix 54; and an ink droplet ejected from a nozzle No. a in the nozzle group 53 lands on a pixel No. a in the print matrix 54. With the printing method that uses two array-shaped nozzle groups 52, 53 to cause ink droplets to land on the print matrix 54 as described above, a certain time difference can be secured between ink droplets landing on adjoining pixels, increasing the possibility of good dots being formed. For example, a landing time difference ΔT between ink droplets landing at adjoining pixels a and b is given by $$\Delta T = Lno/F \tag{3}$$

where Lno (mm) is a distance between the two nozzle groups and F (mm/msec) is a print speed.

Thus, with the print head shown in FIG. 6, the image quality degradation due to the merging of dots can be mitigated by setting the nozzle group distance Lno so as to satisfy the above equation.

However, where the dot diameter is larger than the diagonal length of the pixel (in this case, $42.5\times\sqrt{2}$ μm) or where, even if it is smaller than the diagonal length of the pixel, the dot diameter plus an average of ink droplet landing errors exceeds the diagonal length of the pixel, it is highly likely that adjoining dots will merge. That is, the dot landing time difference between pixel 1 and pixel 2 in one-pass printing is as small as an interval that corresponds to the ink droplet ejection frequency of the nozzles, so that, depending on the dot diameter and the landing error, the adjoining dots may merge as shown in FIG. 18C resulting in a degraded image quality.

Figure 8A:
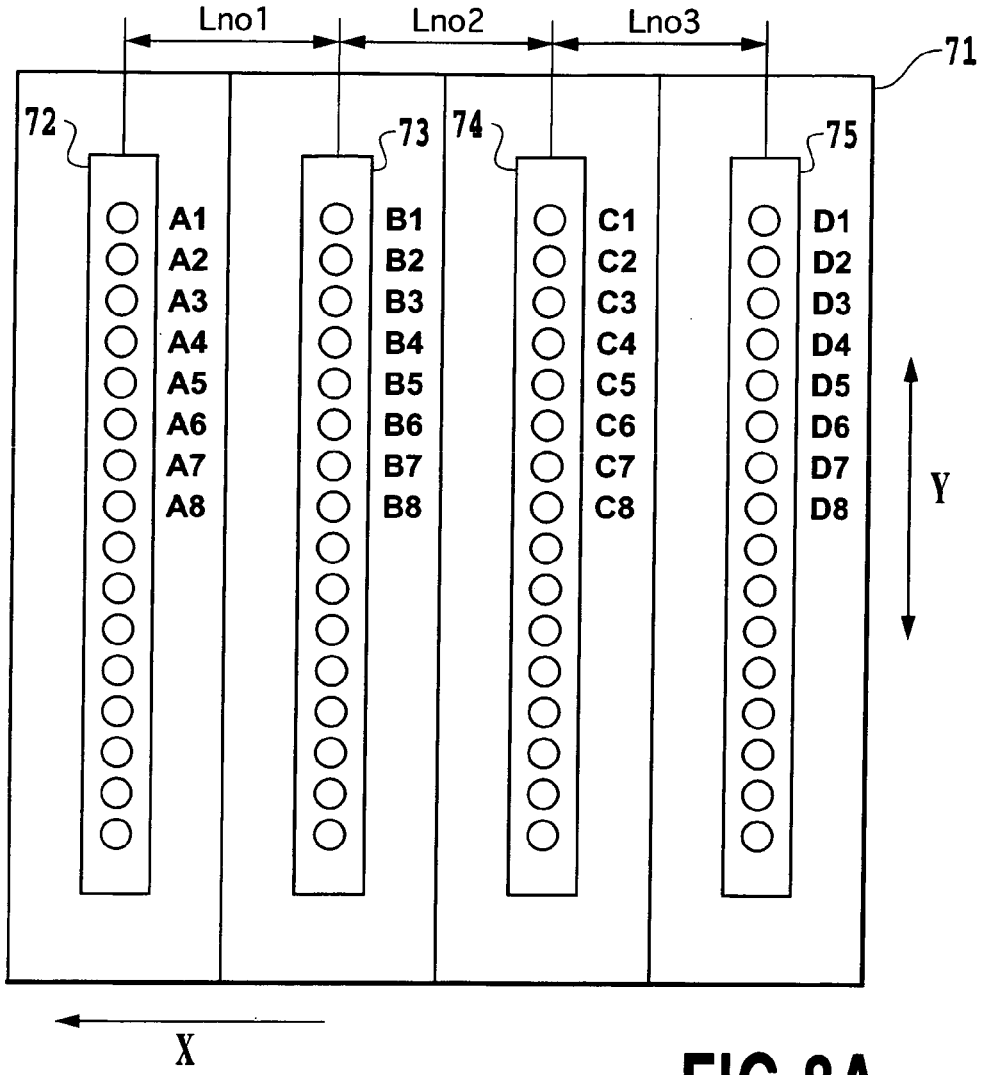
FIG. 8A is a schematic diagram showing a further example nozzle array in the elongate print head according to the related technology of this invention.

To deal with this problem, a print head as shown in FIG. 8A has been proposed. A print head 71 has arranged side by side in the main scan direction (X direction) four nozzle groups 72–75, each having nozzles arrayed almost in a straight line. The nozzle groups 72–75 are spaced at Intervals of Lno1–Lno3.

Figure 8B:
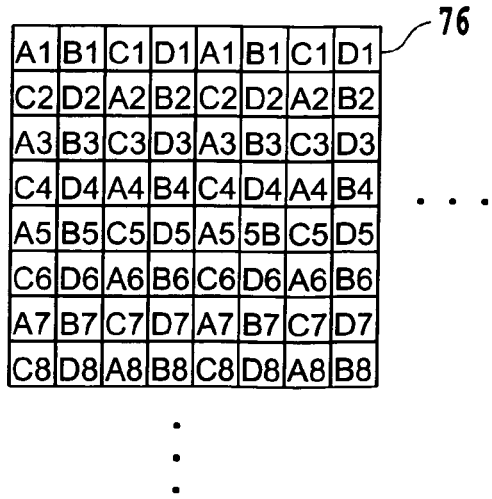
FIG. 8B illustrates an image matrix printed using the print head of FIG. 8A.

A printed result produced by the print head 71 is shown in a print matrix 76 of FIG. 8B. Lno1–Lno3 are all set to the same nozzle array distance, which is defined by the following equation 1 and equation 2.

$$Lpr(\text{mm}) = F(\text{mm/msec}) \times T(\text{msec}) \tag{1}$$

$$Lno \geqq Lpr \tag{2}$$

Here, the print speed F is a relative speed of motion between the print head and the print medium, and T is a time it takes for a predetermined volume of ink, which is shot at a unit area of print medium, to be absorbed in the print medium. Lpr is a nozzle array distance which is calculated by transforming into a distance traveled by the print head relative to the print medium a time it takes for a maximum volume of ink applicable from the print head to a unit area of the print medium to be absorbed in the print medium In the following description the nozzle array distance Lpr is referred to as a maximum ink volume absorption interval. In this specification, a state in which an ink is absorbed in the print medium is one in which the ink applied to the surface of the print medium has penetrated into an interior of the print medium, with no liquid ink remaining on the surface.

In FIG. 8A and FIG. 8B, the nozzle array distance more than the maximum ink volume absorption interval Lpr is set between an ink droplet landing on each pixel and ink droplets landing on all adjoining pixels that adjoin the first pixel in the raster and array directions and in the pixel diagonal direction. Thus, when we look at a pixel A2, for instance, the nozzle array distances between the pixel A2 and the adjoining pixels D2, B2, C1, C3, B1, D3, D1, B3 are larger than the maximum ink volume absorption interval Lpr. This means that ink droplets applied to those pixels adjoining the pixel A2 land after an ink droplet applied to the pixel A2 has been absorbed in the print medium. In that case, dots formed at the pixels of the print matrix 76 may have a diameter larger than one side of the pixel. It is however preferred that the dot diameter be set larger than the pixel diagonal length such that the dots at pixel A1 and pixel A2 will not merge as shown in FIG. 18C. More precisely, the dot diameter may be set to less than pixel size$\times\sqrt{5}$. More preferably, the dot diameter may be set such that the dots at pixel A1 and pixel A3 will not merge as shown in FIG. 18C. For example, it may be set to less than pixel size×2.

Figure 9A:
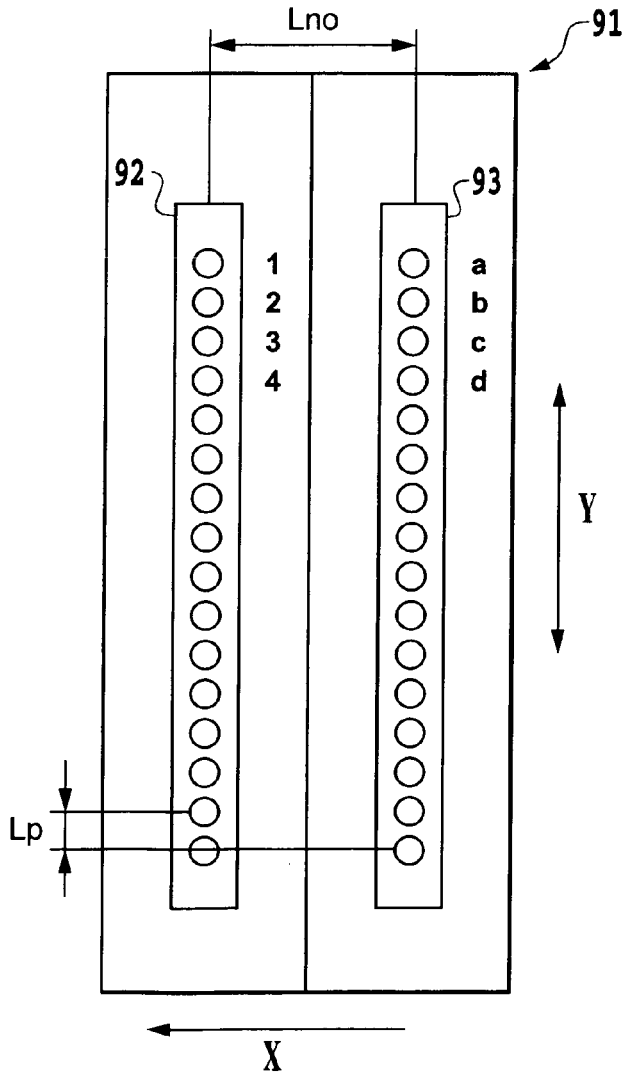
FIG. 9A is a schematic diagram showing a further example nozzle array in the elongate print head according to the related technology of this invention.

The inventor of this invention also proposed a print head 91 as shown in FIG. 9A. This print head has two nozzle arrays 92, 93 each having a plurality of nozzles arrayed in a straight line at a predetermined pitch 9C, with one nozzle array staggered from the other by one-half nozzle pitch (Lp). With this print head, a print matrix can be printed in one pass at a print resolution two times the nozzle density of each nozzle array.

Figure 9B:
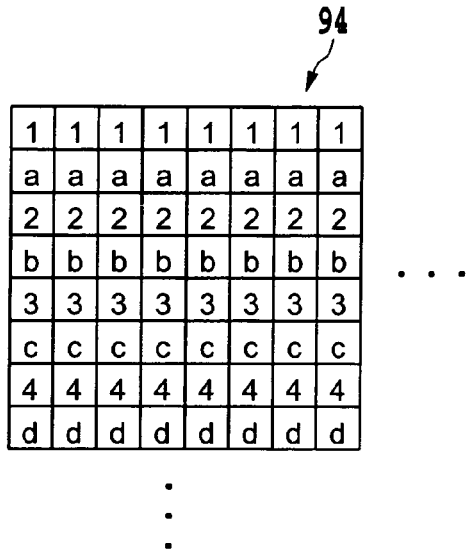
FIG. 9B illustrates an image matrix printed using the print head of FIG. 9A.

With the print head shown in FIG. 9A, the landing time difference between those pixels in a print matrix 94 of FIG. 9B adjoining each other in Y direction, for instance between pixel 1 and pixel a (i.e., line 1 and line a), can be made sufficiently large by setting a nozzle array distance Lno between the nozzle arrays 92 and 93 equal to or larger than Lpr, thereby improving the print quality. However, in the same raster, since the landing time difference corresponds to the ejection drive frequency, there is a possibility that merged dots such as shown in FIG. 18C may be formed.

Figures 10A, 10B:
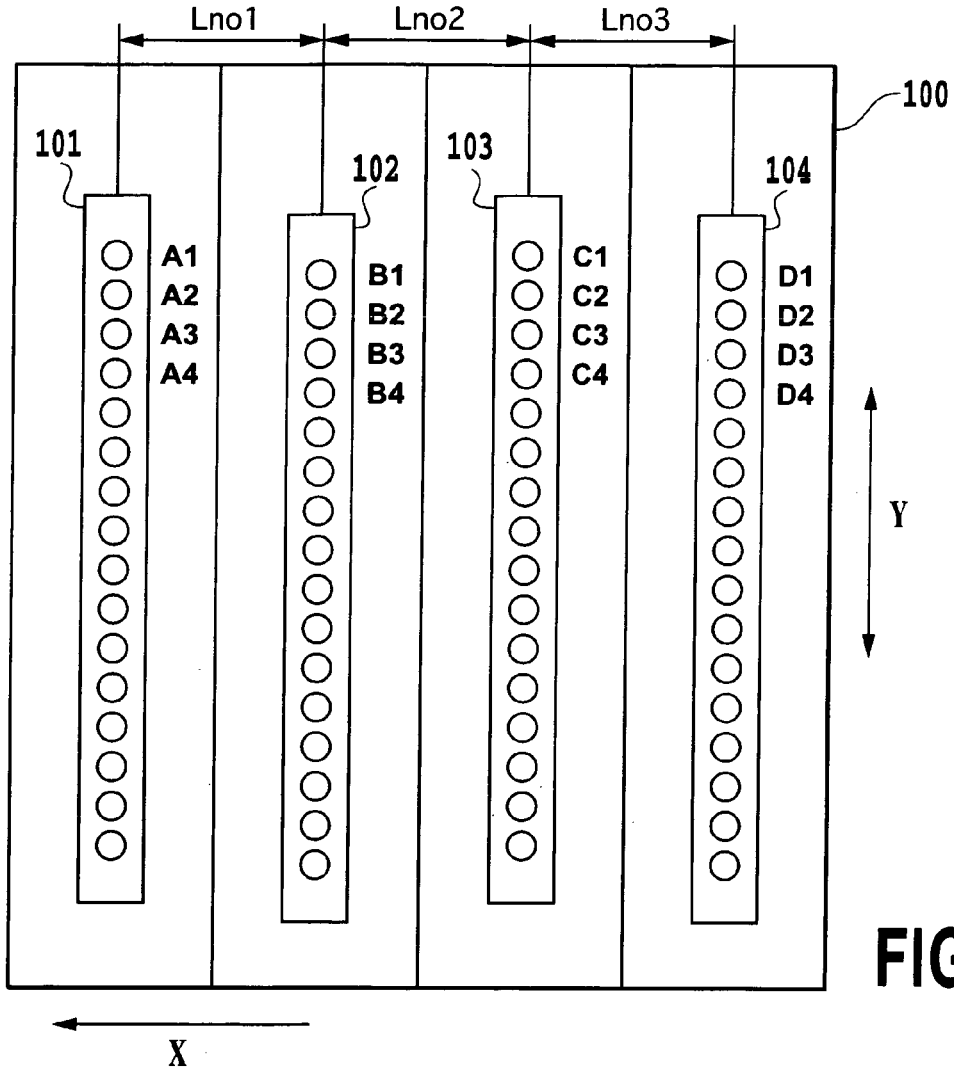
FIG. 10A is a schematic diagram showing a further example nozzle array in the elongate print head according to the related technology of this invention.
FIG. 10B illustrates an image matrix printed using the print head of FIG. 10A.

To solve this problem, the applicant of this invention also proposed a print head 100 as shown in FIG. 10A. The print head 100 has two sets of the two nozzle arrays of FIG. 9A side by side, a total of four nozzle arrays 101–104 integrally formed as one piece.

FIG. 10B schematically shows landing positions of ink droplets ejected from nozzles of the print head 100. As shown in the figure, any ink droplet landing on each pixel can be given a sufficient landing time difference from ink droplets landing on the adjoining pixels. Let us look at a pixel A2, for example All the pixels B1, D1, B1, C2, C2, D2, B2, D2 that adjoin the pixel A2 are printed with ink droplets ejected from the nozzles whose nozzle array intervals (Lno1=Lno2=Lno3) are larger than the maximum ink volume absorption interval Lpr, so their landing time differences can be made sufficiently large. In this print head 100 too, dots formed at the pixels of the print matrix may have a diameter larger than one side of the pixel. It is however preferred that the dot diameter be set larger than the pixel diagonal length such that the dots at pixel A1 and pixel A2 will not merge as shown in FIG. 18C. More precisely, the dot diameter may be set to less than pixel size×$\sqrt{5}$. More preferably, the dot diameter may be set such that the dots at pixel A1 and next pixel A1 will not merge as shown in FIG. 18C. For example, it may be set to less than pixel size×2.

Figure 11:
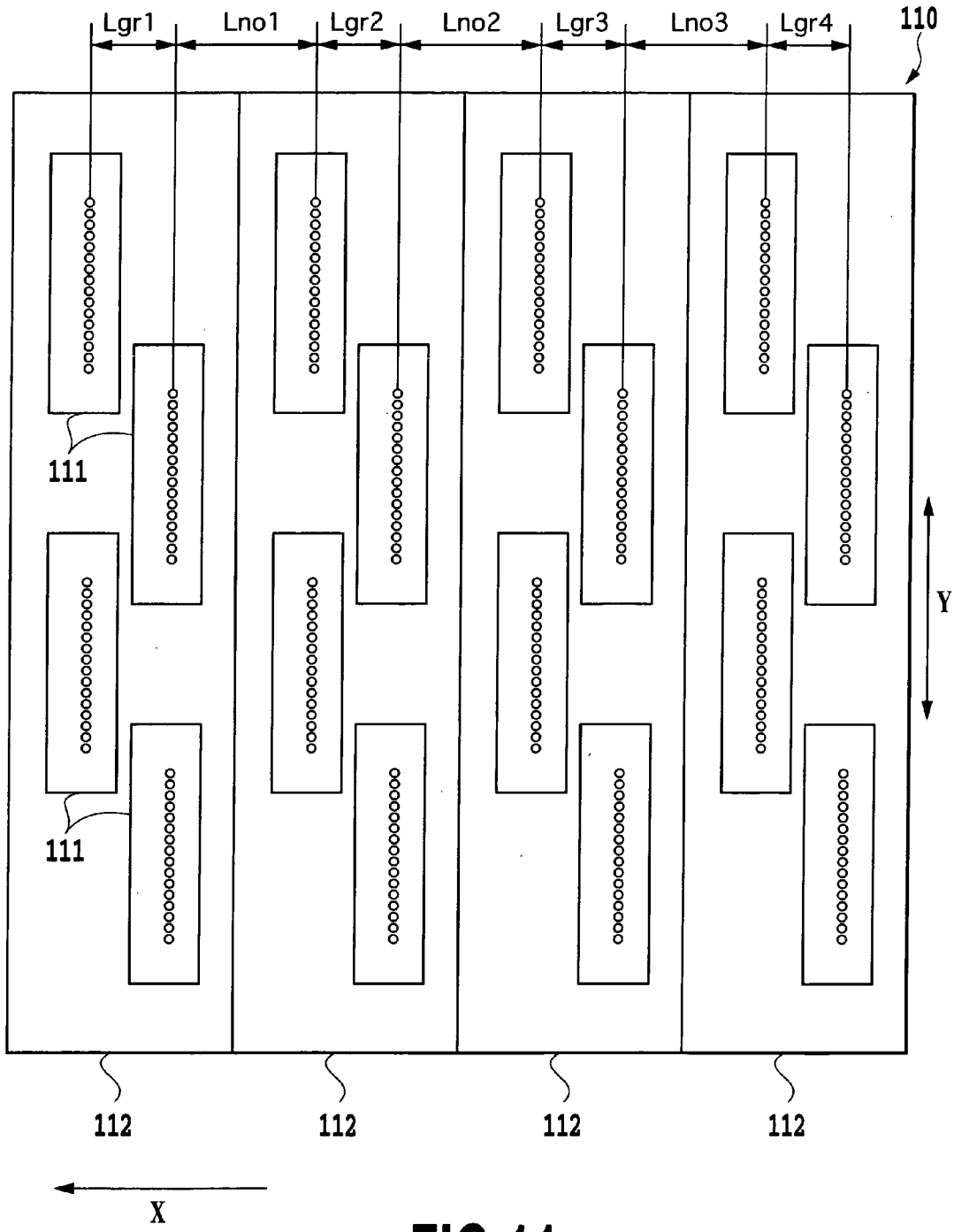
FIG. 11 is a schematic diagram showing a further example nozzle array in the elongate print head according to the related technology of this invention.

In the above we have described the arrangement of a plurality of nozzle groups in the full-line type elongate print head in which nozzle arrays each being arranged in the Y direction almost in a line over a length corresponding to a print width are arranged side by side in the main scan direction (X direction). Another construction of the full-multi type elongate print head has also been proposed as shown in FIG. 11, in which a plurality (in FIG. 11, four) of relatively short nozzle arrays 111. (with a smaller number of nozzles) are arranged in a staggered pattern to form a nozzle group 112. Four of the nozzle groups 112 are arrayed side by side in the main scan direction (X direction) to form a full-multi type elongate print head In the print head 110 shown in FIG. 11, the intervals Lno1, Lno2, Lno3 in the main scan direction (X direction) between the adjoining nozzle groups 112 are all set greater than Lpr. A nozzle array distance Lgr1, Lgr2, Lgr3, Lgr4 in the scan direction between the adjoining nozzles in each nozzle array may be set greater than Lpr, depending on the nozzle distance in the Y direction between end nozzles of those nozzle arrays adjoining in the Y direction. Or, if an enough time difference can be secured between ink droplets landing on the adjoining pixels in the print matrix, the nozzle array distance Lgr1, Lgr2, Lgr3, Lgr4 may be set smaller than Lpr. However, if the end nozzles of each nozzle array have a low landing precision, it is required that the distance in the Y direction between the end nozzles of adjoining nozzle arrays be set narrow. Thus, the nozzle array distances Lgr1–Lgr4 in the scan direction X between the adjoining end nozzles are set larger than Lpr.

In this print head 110 too, by setting the nozzle array distance Lgr1–Lgr4 in the scan direction (X direction) between the nozzle arrays 111 in each nozzle group and the nozzle group distance Lno1–Ln3 in the X direction between the X-direction adjoining nozzle groups to more than Lpr, appropriate merged dots as shown in FIG. 18A can be formed.

Figure 12:
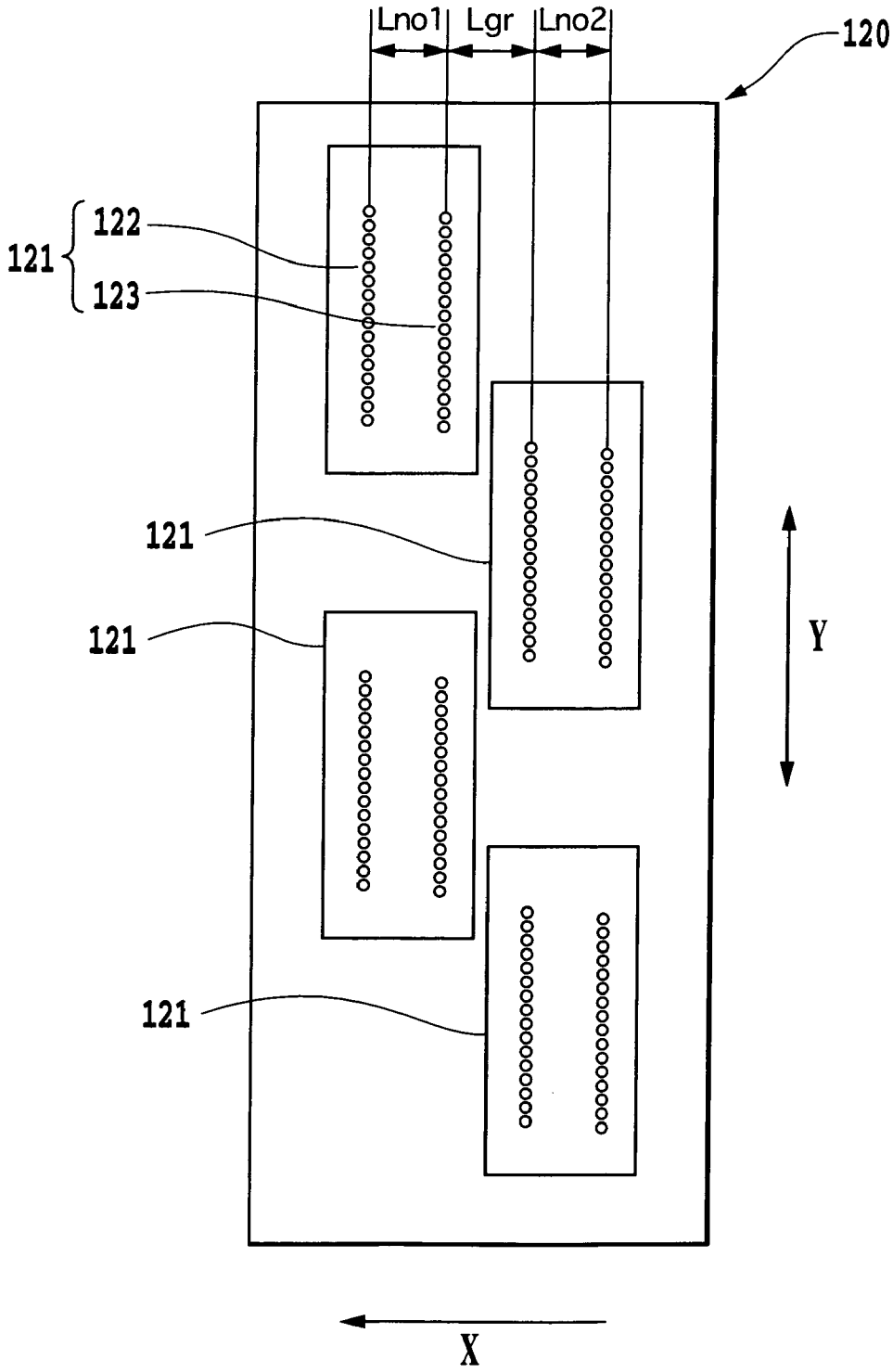
FIG. 12 is a schematic diagram showing a further example nozzle array in the elongate print head according to the related technology of this invention.
Figure 13:
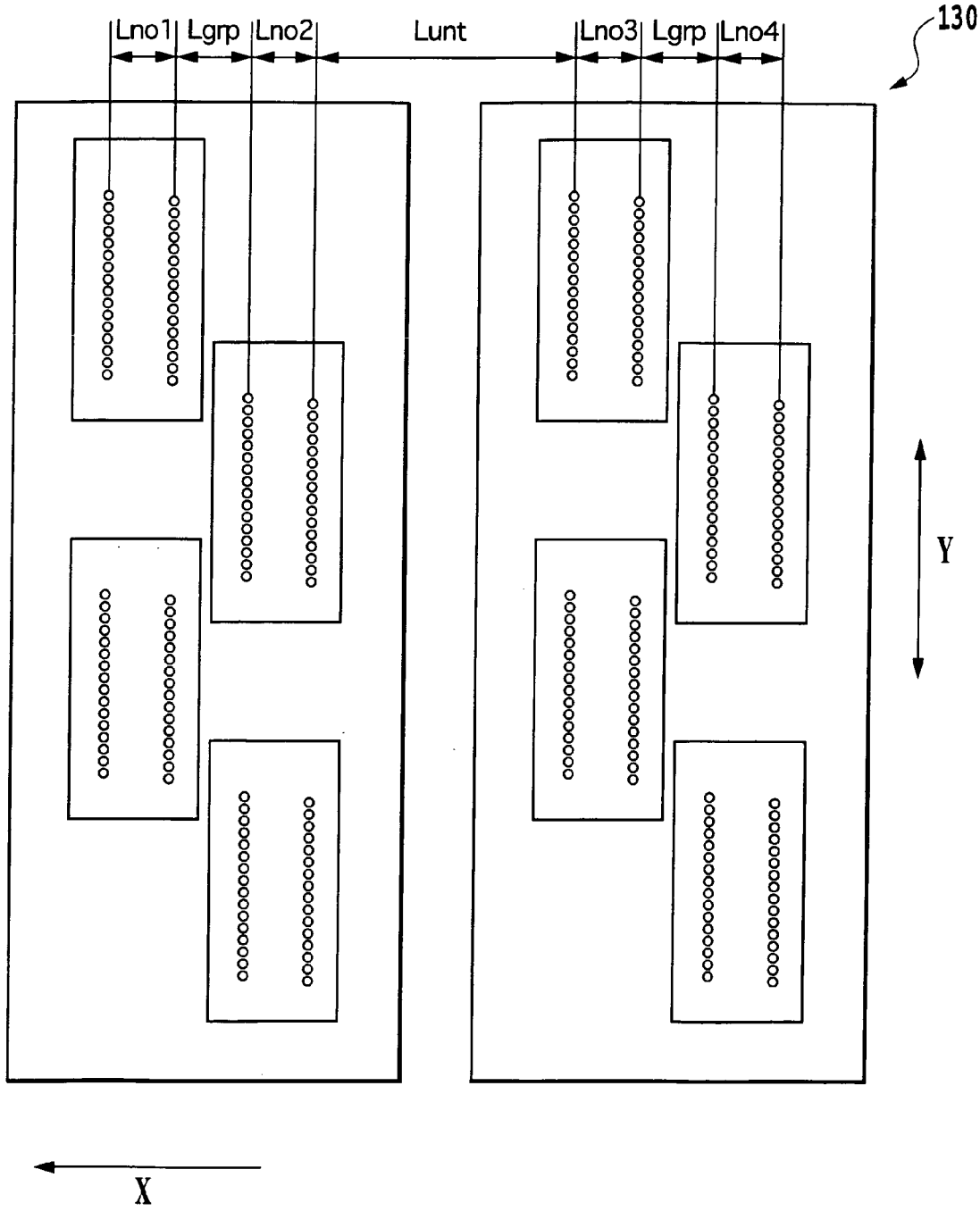
FIG. 13 is a schematic diagram showing a further example nozzle array in the elongate print head according to the related technology of this invention.
Figure 14:
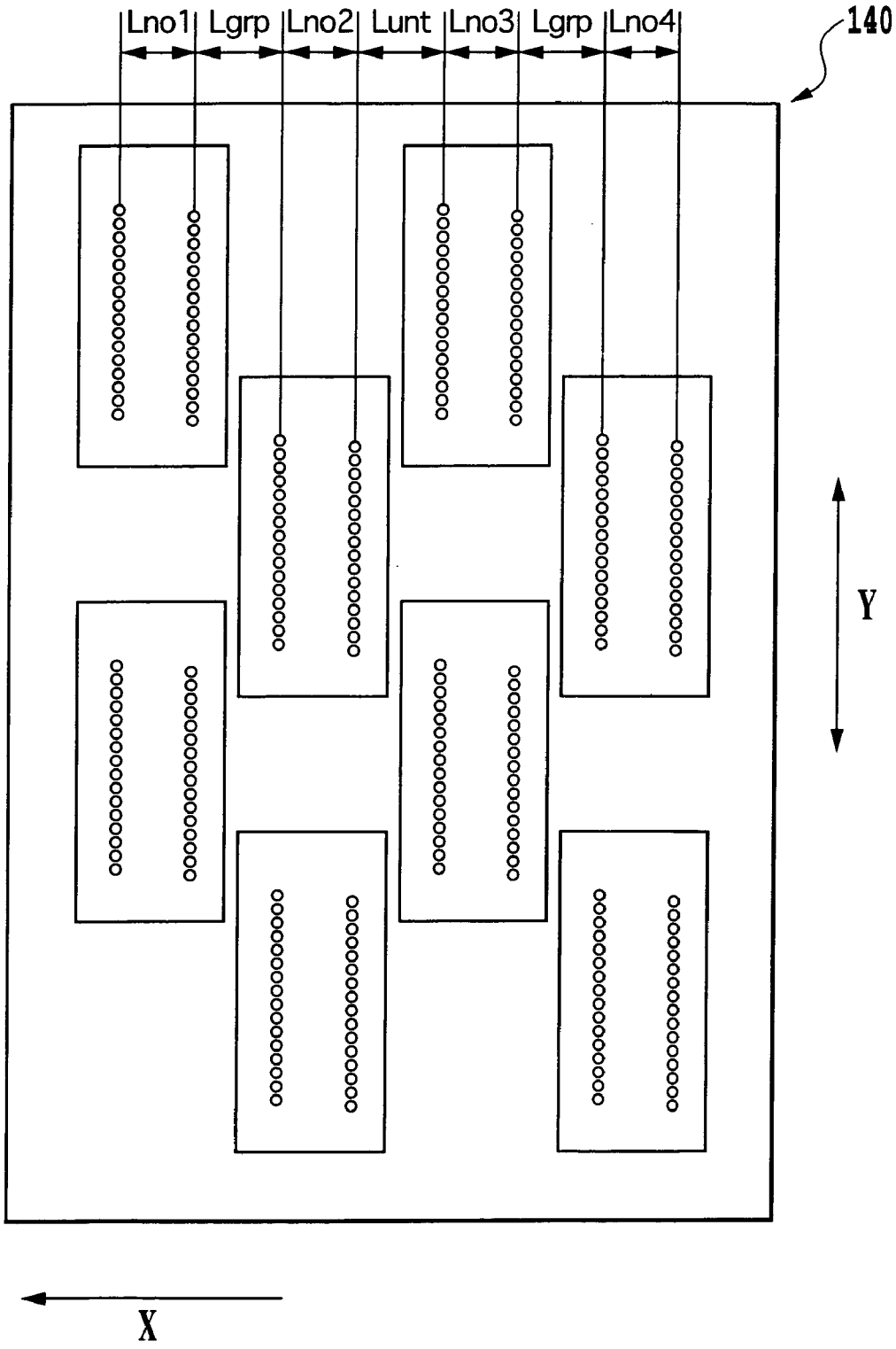
FIG. 14 is a schematic diagram showing a further example nozzle array in the elongate print head according to the related technology of this invention.

Further, the applicant of this invention also proposed print heads as shown in FIG. 12 to FIG. 14.

The print head shown in FIG. 12 has four nozzle groups 121 arranged in a staggered pattern, each nozzle group having two nozzle arrays 122, 123 arranged side by side in the scan direction (X direction). FIG. 13 shows a print head constructed of two print heads 120 of FIG. 12 arranged side by side in the main scan direction (X direction). FIG. 14 shows another print head construction in which two nozzle group combinations, each having the same arrangement of nozzle groups as used in the print head 120 of FIG. 12, are put side by side in the main scan direction.

In FIG. 12, the nozzle array distances Lno1, Lno2 and Lgr are all set larger than the maximum ink volume absorption interval Lpr and are almost equal. In the print head of FIG. 13 and the print head of FIG. 14, Lno1–Lno4, Lgrp and Lunt are all set larger than the maximum ink volume absorption interval Lpr. Therefore, the print heads shown in FIG. 12 to FIG. 14 can form appropriate merged dots as shown in FIG. 18A.

As described above, by setting the main scan direction interval between nozzle arrays adjoining in the scan direction to more than the maximum ink volume absorption interval Lpr, the print heads of the above related technologies can form the adjoining dots in a good merged state, preventing density variation-caused lines and forming an image in good condition.

Now, a method of determining the time it takes for an ink droplet to be absorbed in a print medium (ink absorption time) will be explained.

A measuring method commonly known in the art is "Bristow's method" defined in J-TAPPI. In this method, a change during a very short time in a speed (penetration speed) at which an ink droplet, after it has contacted the surface of the print medium, penetrates into the interior of the print medium can be represented as an absorption rate coefficient. From this value it is possible to calculate the time required by a unit volume of ink to be absorbed into the print medium. Using this method, measurements were made of the time it took for an ink (BCI5C of Canon make) used for BJF850 (Canon make) to be absorbed in Pro-photo paper (PR101 of Canon make), ink jet electrophotographic & plain paper (PB paper of Canon make) and ink jet high-quality dedicated paper (HR101 of Canon make). The following result was obtained.

TABLE 1

| | 5 ml/m$^2$ | 10 ml/m$^2$ | 15 ml/m$^2$ | 20 ml/m$^2$ |
|---|---|---|---|---|
| PR101 | 3 msec | 8 msec | 16 msec | 28 msec |
| PB paper | 0.5 msec | 1 msec | 2 msec | 4 msec |
| HR101 | 0.5 msec | 1 msec | 2.5 msec | 5 msec |

This result has led the inventors of this invention to recognize that it is necessary to set the distance between adjoining nozzle arrays according to the absorption time described above in realizing a full-line type print head suited for high-speed printing. Based on this recognition, the present invention has been accomplished.

For example, in a full-line type print head that completes an image by ejecting the above-described ink onto the Pro-photo paper and performing a printing scan (main scan) of moving the print head relative to the print medium only once (1-pass printing), suppose that a drive frequency that determines a rate at which ink droplets are successively ejected from the nozzles is 10 kHz and that a print density in the scan direction X (resolution of a print matrix) is equal to a nozzle arrangement density in each nozzle group in the sub-scan direction Y, for example, 1200 dpi (i.e., each pixel measures about 20 micron square). Then, the print speed F (mm/msec) is determined to be 0.2 mm/msec. From the above table, the absorption time T (msec) during which 10 ml/m$^2$ of ink is absorbed in Pro-photo paper (PR101) is 8 msec, so the maximum ink volume absorption interval Lpr (mm) is calculated by equation (1) to be 1.6 mm (equivalent to about 80 pixels).

Further, the absorption time T (msec) required for 20 ml/m$^2$ of ink to be absorbed in the Pro-photo paper (PR101) is 28 msec, so the maximum ink volume absorption interval Lpr (mm) is calculated by equation (1) to be 5.6 mm (equivalent to about 265 pixels). The maximum ink volume absorption interval Lpr means a distance between adjoining nozzle arrays such that the time it takes from when a maximum volume of ink applicable to a unit area of the print medium is ejected from each nozzle of the first of the adjoining nozzle arrays and lands on the print medium to spread over the associated unit area until other ink droplets ejected from the second nozzle array land on the print medium is equal to an absorption time required for the maximum volume of ink to be absorbed in the print medium.

Therefore, the Lpr value varies depending on the ink volume used for printing. Normally, it is desired that a total ink volume of all colors be used for the calculation but, if there are sufficient nozzle array distances between nozzle arrays of different colors in the scan direction, the ink volume for each color may be used for calculation.

Although a value determined by the "Bristow's method" is used as the absorption time T to calculate the Lpr value, the absorption time T may be set by using other measuring methods to determine the absorption speed or by a visual check that determines if ink is absorbed. Further, the absorption time may be determined by checking a merged dot made up of two partly overlapping dots formed by two ink droplets that are ejected from those nozzles adjoining in the direction Y crossing the scan direction X.

For example, the merged dot may form into a gourd shape or an oval shape, as shown in FIG. 18A, FIG. 18B and FIG. 18C. By checking an optical density distribution and a shape of an overlapping portion of the two dots making up the merged dot, the absorption time can be determined. That is, if two dots land on a print medium at a short time interval, they merge into an oval shape, as shown in FIG. 18C. If two dots land on the print medium with somewhat longer time difference, they merge as shown in FIG. 18B. If two dots land with a still longer time difference, the merged dot is shaped as shown in FIG. 18A. Comparison of these merged dots shows that they differ in density and shape, so checking the difference in density and shape can determine the absorption time. A merged dot such as shown in FIG. 18A has an almost similar optical density distribution as that of a merged dot that is formed by landing two ink droplets at a time interval corresponding to the absorption time measured by the Bristow method.

The related technologies described above consider the landing time difference between ink droplets ejected from the adjoining nozzles to prevent the dots making up the merged dots on the print medium from merging so close together, as shown in FIG. 18C as will degrade an image quality. This makes it possible to form a high quality image.

In the above related technologies, however, the ink ejection volume (print duty) is set for each nozzle group or for each nozzle array without taking into account the side-by-side arrangement of the nozzle groups or nozzle arrays in the scan direction. Thus, there is a possibility that a large amount of ink may be ejected from a nozzle array situated downstream in the scan direction. In that case, the ink absorption time for the downstream nozzle array becomes long and thus the distance between the nozzle arrays are set according to this prolonged ink absorption time. Therefore, where there are three or more nozzle arrays, the width of the print head in the scan direction X becomes large, which in turn increases the overall size of the printing apparatus. To avoid an increase in the size of the print head, a method has been practiced which reduces a relative scan speed between the print head and the print medium. This method, however, poses another problem of a reduced print speed.

Especially with a print medium having an air gap type ink absorption layer., such as PR101, the time required for an ink droplet to be absorbed in the ink absorption layer tends to be greater than those of plain paper and high-quality dedicated paper, as shown in the table of measurements Thus, when the above related technologies are applied to such a print medium, these problems become more noticeable.

Embodiments of this invention, on the contrary, can avoid an increase in the size of the print head and at the same time enhance the print speed.

Embodiment of this Invention

Now, one embodiment of this invention will be described in detail.

This Invention provides a printing apparatus using a full-line type print head described in the above related technologies, which is advantageously applied where two or more color inks or a large number of print head units are used to form an image in one printing scan or in a small number of printing scans. In this invention, a nozzle group is made up of at least one nozzle array which has a large number of nozzles arrayed in a direction (Y direction) perpendicular to the scan direction (X direction) in which the print head moves relative to the print medium. One or more nozzle groups make up a print head unit. Thus, when one print head unit is constructed of one nozzle group, the nozzle group and the print head unit are practically identical.

Figure 17:
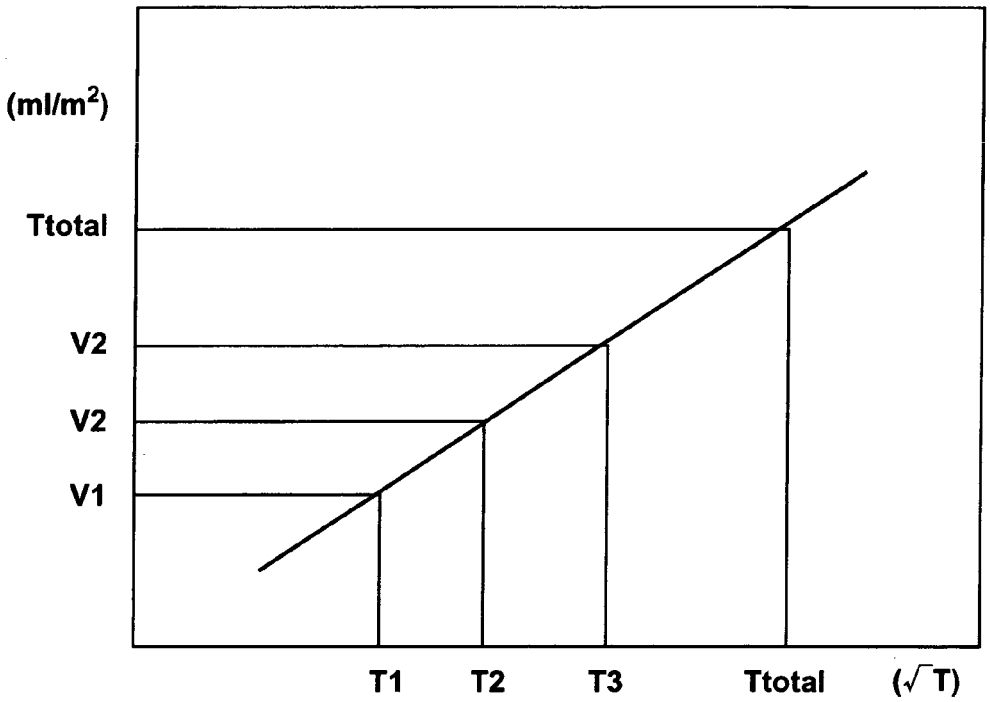
FIG. 17 is a graph showing a relation between an ink volume ejected onto a print medium and an ink absorption time.

In implementing this invention, the inventor of this invention has discussed the process in which ink droplets ejected from a print head unit or nozzle group situated upstream (on the front side) in the main scan direction and ink droplets ejected from a print head unit or nozzle group situated downstream (on the rear side) are absorbed in the print medium. Our observation of the process has led us to conclude that, to determine the absorption time of an ink droplet applied to the print medium, it is important to consider the amount of ink that has already been applied to the print medium before the ink droplet of interest is applied. FIG. 17 shows a relation between an amount of ink applied to the print medium and an ink absorption time. In the figure, the ordinate represents the amount of ink applied to the print medium and the abscissa represents the time required to absorb the applied ink (absorption time).

Where the print medium is required to absorb ink droplets instantaneously as in the one-pass printing, it has become evident that there is a tendency, though its degree varies according to the kind of print medium, that while an ink droplet first applied to the print medium is absorbed quickly, the absorption of subsequently applied ink droplets is slow. This can also be predicted from the measured data of the absorption time based on the Bristow's method. For example, PR101 takes 8 msec to absorb a first 10 $ml/m^2$ of ink but takes 20 msec to absorb an additional 10 $ml/m^2$. So, PR101 will take 26 msec to absorb 20 $ml/m^2$.

When 20 $ml/m^2$ of ink is to be used for printing, the most efficient way of printing thus involves applying a first 10 $ml/m^2$ of ink from a print head unit or nozzle group situated the most upstream, 5 $ml/m^2$ from a print head unit or nozzle group situated immediately downstream, and a remaining 5 $ml/m^2$ from a print head unit or nozzle group situated further downstream. This method can prevent an overflowing of ink on the print medium and still allow a fast printing using a print head construction in which distances between print head units or nozzle groups are set almost equal.

As described above, in a printing apparatus having a plurality of print head units or nozzle groups arranged in the main scan direction, a print duty defining the amount of ink to be applied from a print head unit or nozzle group on the upstream side is set higher than a print duty for a print head unit or nozzle group on the downstream side to realize a fast printing in the print head construction having the print head units or nozzle groups arranged at equal intervals. Further, since only those print head units or nozzle groups having the same intervals need to be prepared, the cost of the printing apparatus can be reduced.

Now, referring to FIG. 15, an embodiment of this invention will be explained in more detail. In this embodiment a front side (to the left in the figure) of the scan direction (X direction) in which the print head moves relative to the print medium is taken as an upstream side, and a rear side (to the right in the figure) as a downstream side. That is, when the print medium is moved to the print position in the printing apparatus, a print head unit that first faces the print medium is referred to as an upstream print head unit and a print head unit that faces it second is referred to as a downstream print head unit.

Figure 15:
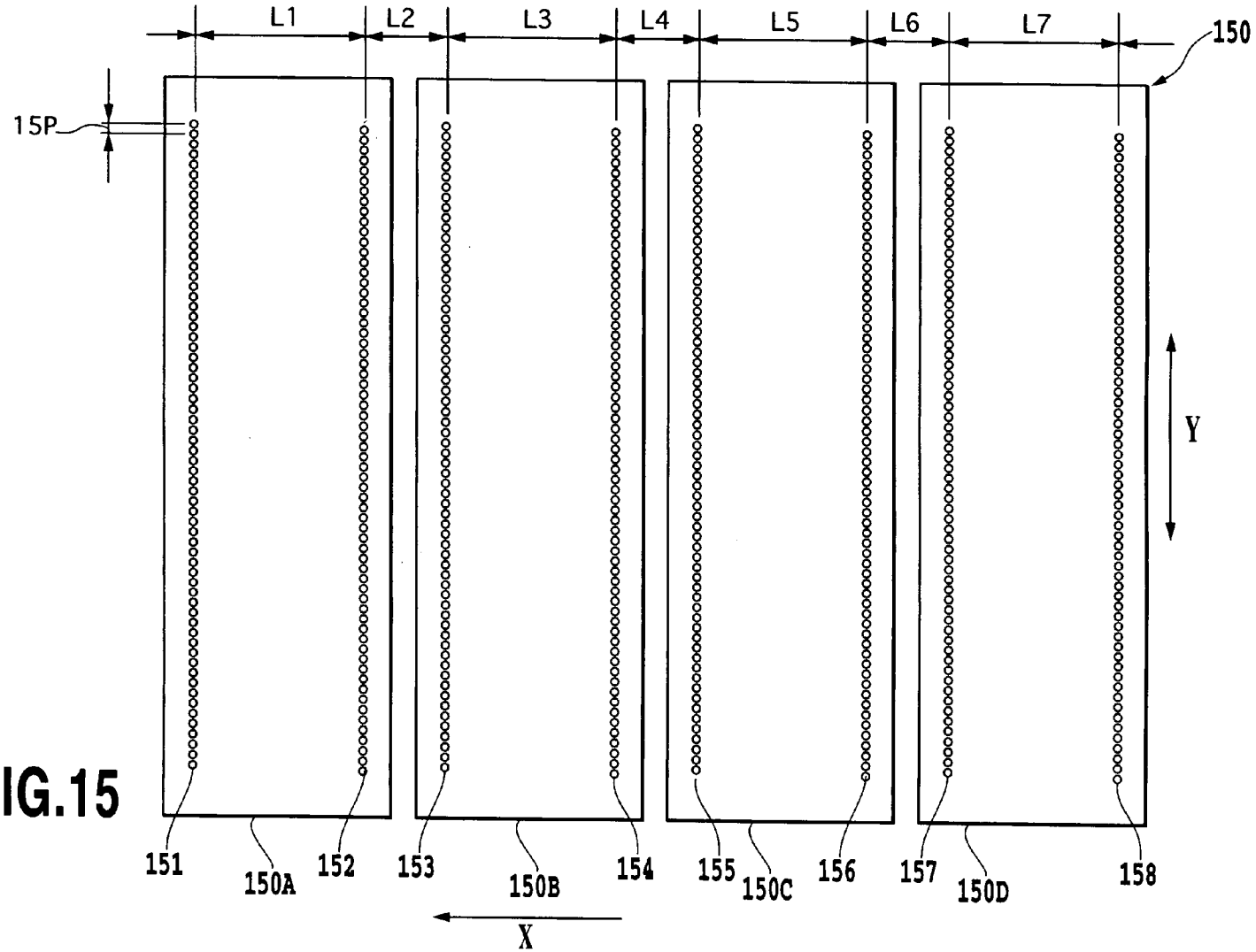
FIG. 15 is a schematic diagram showing a nozzle array in the elongate print head in one embodiment of this invention.
Figure 16:
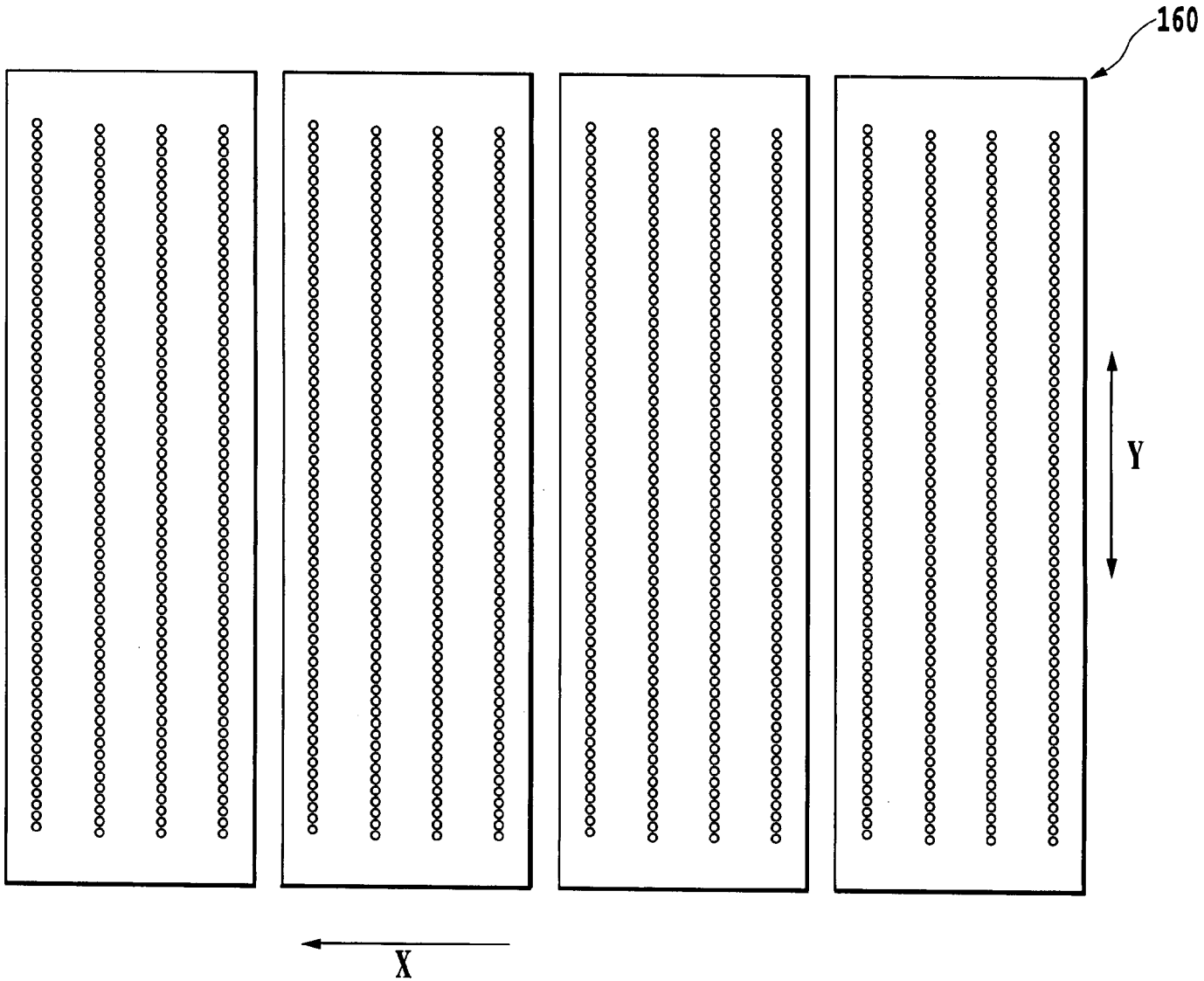
FIG. 16 is a schematic diagram showing a nozzle array in the elongate print head in another embodiment of this invention.

As shown in FIG. 15, in this embodiment a printing operation is performed using a print head 150 which has a plurality (in the figure, four) of print head units arranged side by side from an upstream side to a downstream side in the main scan direction. Each print head unit has a plurality (in the figure, two) of nozzle arrays arranged side by side, each nozzle arrays having a plurality of ink ejection nozzles arrayed almost in a straight line along a sub-scan direction (Y direction) perpendicular to the main scan direction.

In the figure, reference number 150A represents a print head unit situated most upstream, from which print head units 150B, 150C, 150D are arranged side by side toward the downstream side. Each of the print head units has an upstream nozzle array and a downstream nozzle array. The nozzles making up each of the nozzle arrays are arrayed at equal pitches 15P and the nozzles of the downstream nozzle array are situated between the nozzles of the upstream nozzle array with respect to the Y direction. That is, the downstream nozzle array is staggered from the upstream nozzle array in the Y direction by one-half the pitch 15P. This arrangement enables each of the print head units to form dots at virtually the same density as does a print head unit whose nozzles are arrayed in a straight line at one-half the pitch 15P.

In the figure, reference numbers 151, 153, 155, 157 represent nozzle arrays on the upstream side in each print head unit and reference numbers 152, 154, 156, 158 represent nozzle arrays on the downstream side. These eight nozzle arrays are arranged side by side from the upstream side to the downstream side in the order of 151–158. In the following description, 151 is called a first nozzle array, 152 a second nozzle array, 153 a third nozzle array, 154 a fourth nozzle array, 155 a fifth nozzle array, 156 a sixth nozzle array, 157 a seventh nozzle array and 158 an eighth nozzle array. The print head unit 150A ejects a cyan ink (simply referred to as C), the print head unit 150B a magenta ink (M), the print head unit 150C a yellow ink (Y) and the print head unit 150D a black ink (K).

In the print head constructed as described above, distances L1, L3, L5, L7 represent nozzle array distances between the two nozzle arrays in each print head unit, and distances L2, L4, L6 represent head unit distances between the adjoining print head units Considering an effect on image quality when a high-speed printing is done, the nozzle array distance in each print head unit needs to be set so that the applied ink will not overflow on a print medium. For this reason the nozzle array distance is determined as follows.

It is assumed that the print head units 150A, 150B, 150C and 150D are to eject C, M, Y and K inks respectively and that, when an image is completed in one printing scan these inks are ejected in the order of C, M, Y and K from the upstream side. A maximum ejection volume for each ink C, M, Y, K is set at 10 ml/m$^2$ and a total ejection volume at 20 ml/m$^2$. It is also assumed that a printing operation is performed by setting a print duty so that the ink volume applied to one square meter of a print medium is 10 ml for C, 10 ml for M, 0 ml for Y and 0 ml for K. In that case, since 10 ml of C is already applied to the print medium before M is applied, this setting of an ink application volume ratio makes it most likely that the applied ink will overflow on the print medium. When we consider the state in which the ink is very likely to overflow, the distance L4 between the print head units 150B and 150C needs to be set to match 18 msec. This head unit distance L4 is 3.6 mm when the print frequency is 10 kHz and the resolution in the scan direction is 1200 dpi.

If the print head units of the four color inks are manufactured by the same process, the manufacturing cost can be reduced by setting the head unit distances equal. Thus, the head unit distances are all set to the same distance as that between the print head unit that ejects ink under the worst condition, most likely to result in ink overflow, and a print head unit situated immediately downstream. That is, all the print head unit distances L2, L4, L6 are set to 3.6 mm, the head unit distance L4 between the print head unit 150B of M ink and the print head unit 150C of Y ink.

In the print head with the print head unit distances set as described above, if ink ejection volumes are set at 5 ml for C, 3 ml for M, 2 ml for Y and 5 ml for K, an ink of greater ejection volume is applied from a print head unit situated more on the upstream side. That is, the inks are ejected in the order of C, K, M and Y from the upstream side. The absorption times that the print medium takes to absorb the inks ejected from the different print head units are determined as follows.

From the result of measurements based on the Bristow method, the relation between the absorption time T and the absorbed ink volume V is approximated as follows in a polynomial expression.

$$V=0.06T^2+0.2T$$

Using this equation, the absorption times of the print medium (PR101) for these inks are 2.5 msec for C, 5.5 msec for K, 4.7 msec for M and 3.7 msec for Y. The print head unit 150B of K ink that requires the maximum absorption time is checked. If the head unit distance is set at 3.6 mm, the relative motion speed between the print head unit and the print medium, i.e., the print speed, is determined to be $$3.6(\text{mm})/5.5(\text{msec})=0.65\ \text{mm/msec}$$

If the printing is done at this speed, all inks can be reliably absorbed in the print medium during the printing operation. Thus, where merged dots made up of partly overlapping adjoining dots are formed, they are properly shaped at all times as shown in FIG. 18A, allowing for the printing of a high-quality image without optical density variations.

In the conventional printing apparatus, on the other hand, the ejection order of color inks is set without regard the ink ejection volume. Suppose the same ink volumes as in the above example are to be ejected in one square meter (5 ml for C, 3 ml for M, 2 ml for Y and 5 ml for K) and that these inks are ejected in the order of C, M, Y and K. Also suppose the head unit distances are set at 3.6 mm as in the above example. When the K ink is ejected, 10 ml/m$^2$ of other inks is already applied to the print medium. So, the absorption time for K is 8 msec and this is the maximum absorption time. Based on this maximum absorption time, the print speed is set. It is calculated as follows.

$$3.6(\text{mm})/8(\text{msec})=0.45\ \text{mm/msec}$$

The comparison between the print speed of 0.45 mm/msec in the conventional printing apparatus and the print speed of 0.65 mm/msec in this embodiment clearly shows that this embodiment can print about 14 times faster than the conventional apparatus.

As described above, since this embodiment analyzes image data and activates print head units in the descending order of print duty by arranging the head units so that a head unit with a higher print duty comes on the upstream side of other head units, successive ink ejections from different head units can be executed at an interval of the maximum ink absorption time required of the head units This makes for a high quality image and significantly improves the print speed. Further, since an ink application to the print medium is done in a way that allows a large volume of ink to be absorbed efficiently, the distances between the print head units can be kept to a minimum required, thus preventing an increase in size of the print head and therefore the printing apparatus.

In this embodiment, before starting a printing operation, some prior arrangements need to be made, such as changing an ink supply path according to an image to be printed and placing a print head unit with a high print duty on the upstream side. These operations or arrangements will take some time. However, when a large number of copies of the same images are printed (particularly in a print-on-demand mode of printing operation), these prior arrangements can in the end improve a throughput, resulting in a reduced delivery time and cost. This embodiment therefore is particularly advantageous for a full-line type page-wide printer that prints a large number of copies of the same images or of print materials with nearly equal print duty distributions among different colors.

Figure 20:
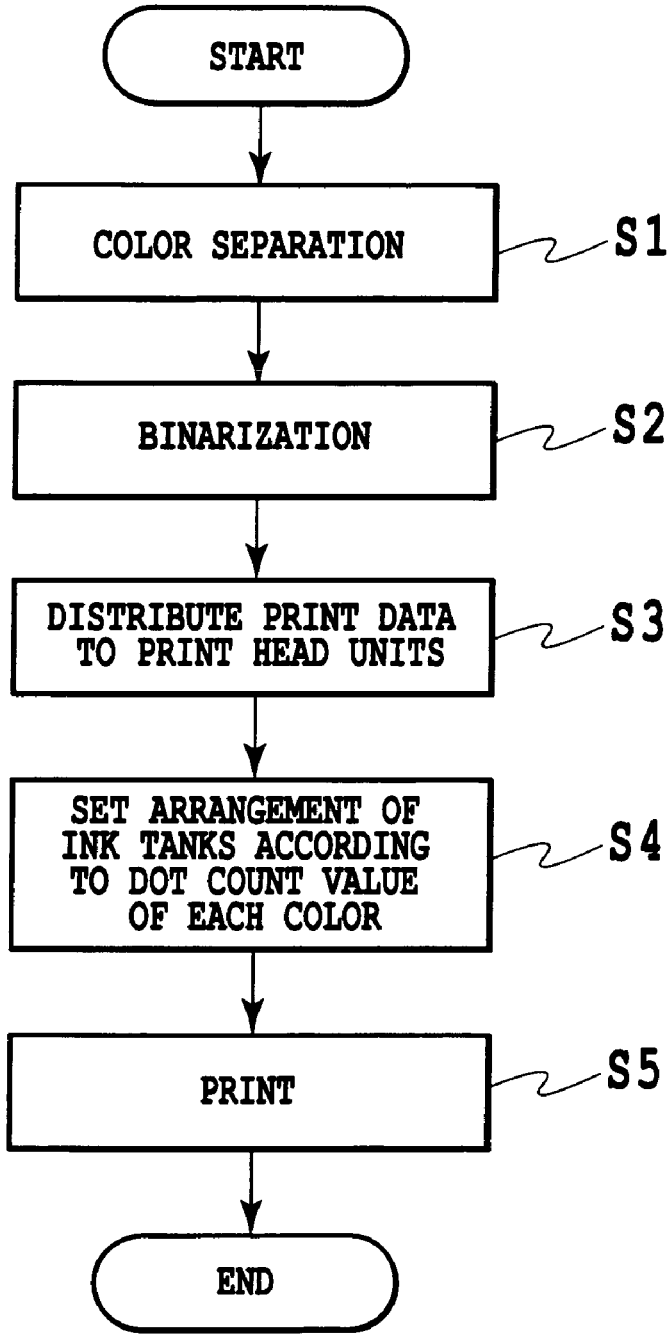
FIG. 20 is a flow chart showing an example sequence of a printing operation including print data generation processing, applied to the embodiments of this invention.

An example sequence of printing operation including print data generation processing applied in the above embodiment will be explained by referring to a flow chart of FIG. 20.

First, input image data is color-separated into the same number of data groups as that of color inks used in the printing apparatus (step S1) and then transformed into grayscale print data for each color. For example, when a print head having a predetermined number of nozzles arrayed in array at a density (interval) of 1200 dpi is used, the input image data is transformed into binary data that specifies whether or not an ink dot is to be formed in each pixel of 1200×1200-dpi print matrix (step S2). This conversion is performed by an error diffusion method.

The binary data is distributed to four print head units arranged side by side in the scan direction (step S3). For example, when binary data is allocated to four print head units of FIG. 15, the pixel data corresponding to individual pixels of the print matrix may be used as drive data for each print head unit, or data allocation may be done by using mask data prepared separately. The print data is allocated to the print head units in such a way that print data of a color with a high print duty is supplied to a print head unit on the upstream side, as described earlier. This can be realized by setting low a thinning out rate of mask data supplied to the upstream print head unit and setting high the thinning out rate of mask data supplied to the downstream print head unit. Further, according to the print duty of each color, the order of arrangement of color ink tanks is determined (step S4). This ink tank arrangement order is shown on a display unit provided on a printing apparatus side or a host computer side. Then, according to a content shown on the display unit the user rearranges the order of the ink tanks so that a color ink with the highest print duty is supplied to the most upstream print head unit and a color ink with the second highest print duty is supplied to the second most upstream print head unit and so on. With this rearrangement made, the printing operation is started (step S5).

The allocation of print data as described above may result in a small number of improper merged dots such as shown in FIG. 18C being formed because there is an insufficient landing time difference between ink dots applied to adjoining pixels during the printing operation. However, such improper merged dots, should they be formed at all, will not pose any serious problem as long as a rate of occurrence of the improper merged dots is within a tolerable range beyond which an image degradation becomes noticeable.

Figure 21:
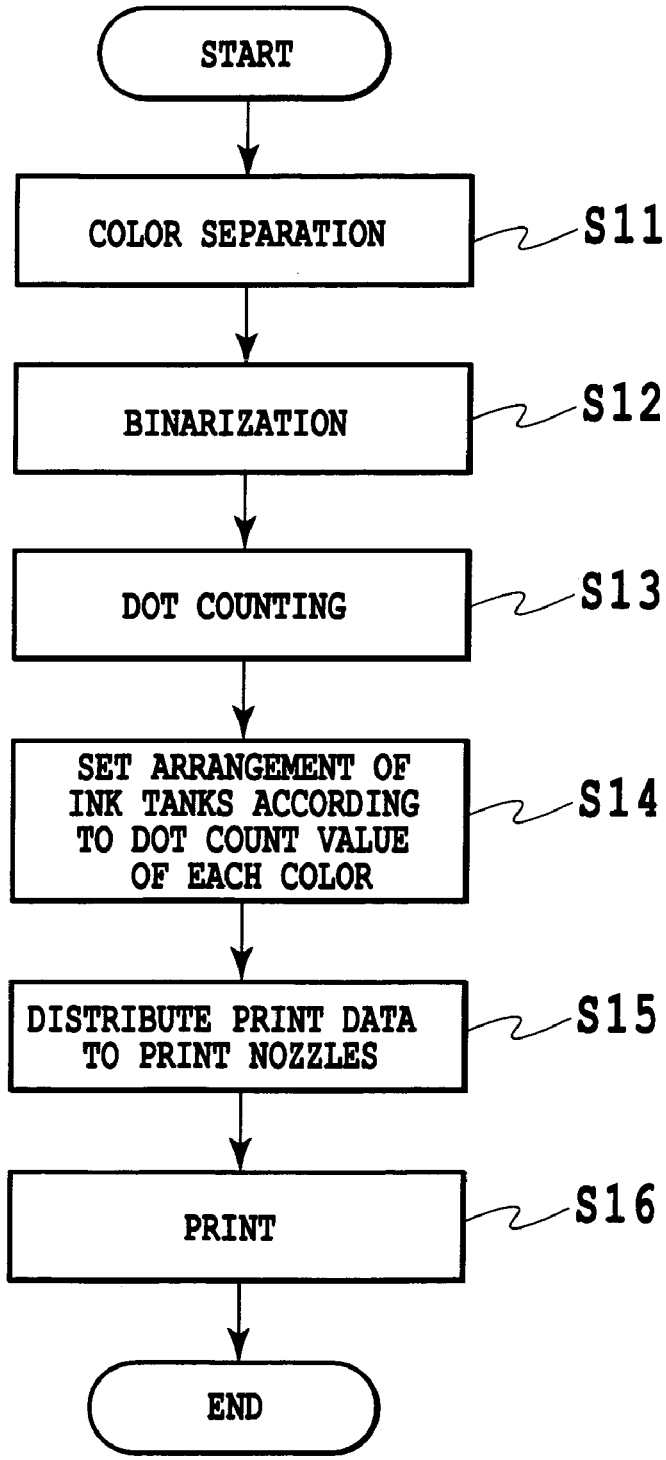
FIG. 21 is a flow chart showing another sequence of a printing operation including print data generation processing, applied to the embodiments of this invention.
Figure 22:
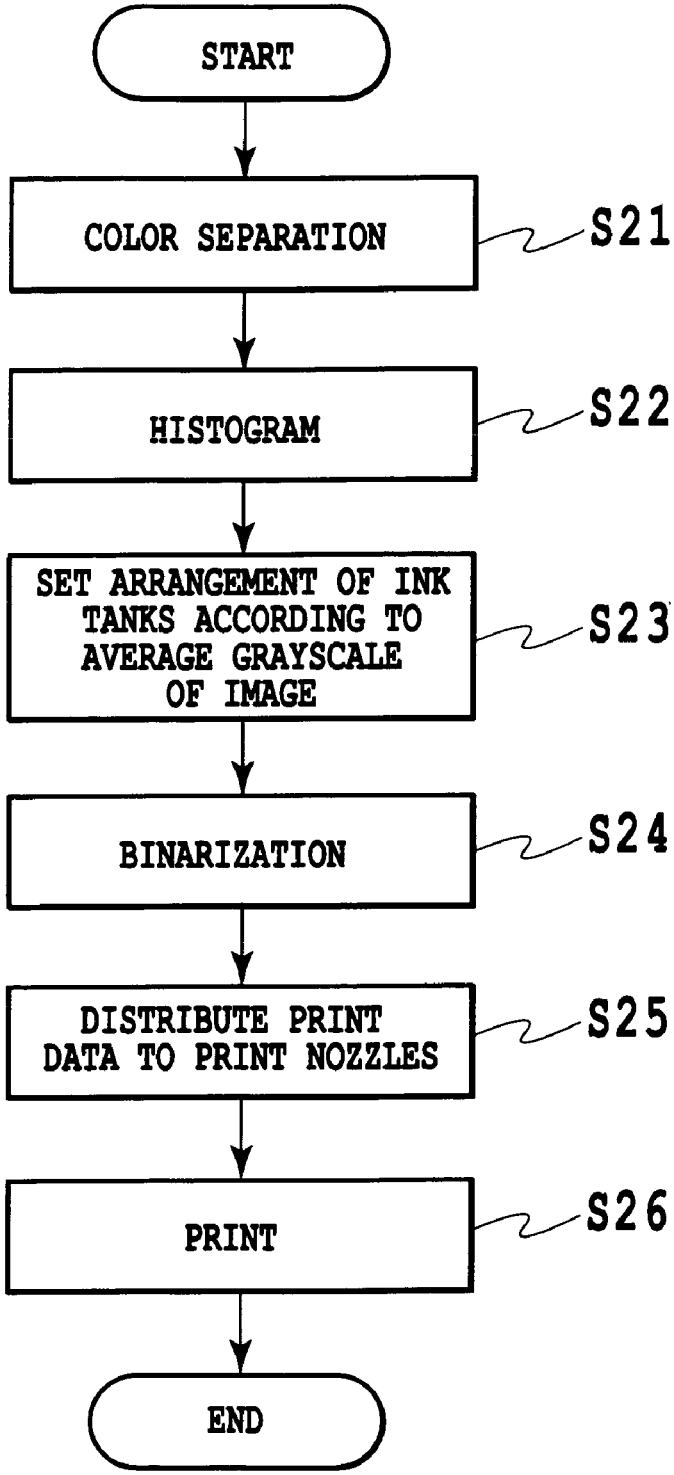
FIG. 22 is a flow chart showing still another sequence of a printing operation including print data generation processing, applied to the embodiments of this invention.

Other example sequences of printing operation are shown in FIG. 21 and FIG. 22

In the printing operation sequence shown in the flow chart of FIG. 21, print data that is color-separated at step S11 is converted into binary data at step S12, which is counted to determine a dot count value for an image of each color (step S13). Based on the dot count value, the arrangement order of ink tanks is determined (step S14). That is, the ink tanks are arranged so that an ink tank of a color with a larger dot count value is connected to a print head unit on the upstream side. Step S15 allocates binary data to the print head units, after which a printing action is executed according to a predetermined print instruction (step S16).

Further, a sequence shown in FIG. 22 may be employed.

Based on print data color-separated at step S21, a histogram is generated for each color (step S22). According to the histograms an average grayscale of image is determined for each color, based on which the arrangement of the color ink tanks is determined (step S23). The user then installs the ink tanks according to the determined arrangement order. At step S24, S25, the print data for each color is binarized and the binary data is allocated to the print head units. Then, a printing action is started according to a predetermined print instruction (step S26).

Other Embodiments

While in the above embodiment an example case of each print head unit having two nozzle arrays has been described, this invention is also applicable to a full-line type elongate print head 160 in which each print head unit is constructed of four nozzle arrays. The number of nozzle arrays in each print head unit may be changed as required.

In this embodiment with the print head units spaced at equal intervals, let us consider a case of printing a monotone image for example. In this case, when converting print data into print head unit drive data and allocating it to the associated print head units, an object of this invention can be achieved by increasing an allocation rate for an upstream print head unit.

Further, suppose the nozzle arrays or print head units are arranged side by side in the scan direction in the order of K, C, M and Y but that the print data to be printed increases in the order of C, Y, M and K. In that case, the print head units may be rearranged in the order of K, M, Y and C from the upstream side and the arrangement order of the ink tanks changed to ensure that correct color inks are supplied to the associated print head units. Changing the arrangement order of both the ink supply system such as ink tanks and the print head units in this way can eliminate a problem that, at an initial stage of printing operation, inks remaining in the print head units and inks being newly supplied mix together, as will occur when only the ink supply system is changed.

Further, in a system that prints many kinds of images in small numbers of copies, for example, a photography printer that prints color images, such as snap pictures, landscapes, portraits and still life, cyan, magenta and yellow inks are normally used in greater amounts than a black ink. In this case the arrangement of the print head units and the associated ink tanks needs to be set in advance so that cyan, magenta and yellow inks are used on the upstream side of the scan direction.

Further, in a printing apparatus with a print head that uses six or seven color inks, some of them the same colors but with different grayscale levels, those print head units ejecting light cyan and light magenta inks, which are used more frequently than other color inks, need to be situated on the upstream side.

Further, in a printing apparatus that mainly prints images with a black ink at high duty, for example medical images such as X-ray pictures and night landscapes, what is needed in this case is to put a print head unit of black ink and/or the associated ink tank on the upstream side.

Furthers in a printing apparatus dedicated to printing a particular type of images, such as the one described above, the arrangement order of the print head units and the associated ink tanks may be fixed. But for flexibility in dealing with a variety of kinds of images, the direction in which a print medium is fed to the print head may be changed.

When, for example, the print head units are arranged in the order of C, M, Y, K, the duties of colors of an image to be printed may be checked and the paths for supplying inks to the print head units changed so that a print head unit of a color with higher duty is placed on the upstream side. It is also possible to change, according to the print duty of each color, the arrangement of the print head units in addition to changing the arrangement of ink tanks and ink supply paths. By changing the arrangement of both the ink supply system such as ink tanks and the print head units as described above, it is possible to eliminate a problem that, at an initial stage of printing operation, inks remaining in the print head units and inks being newly supplied mix together, as will occur when only the ink supply system is changed.

Then, the user changes the arrangement of the ink tanks, an ink source for supplying inks to the print head units (step S4), to ensure that an ink with the highest print duty is supplied to a print head situated most upstream, with an ink having the next highest print duty supplied to a print head situated the next most upstream, and so on. With this arrangement made, the print action is started.

The ratio of allocation of print data to a plurality of print head units may also be changed according to a kind of image to be printed. For example, when two print head units are used to print an image with a print duty of about 60%, the print duty of an upstream print head unit may be set at 40% and the print duty of a downstream print head unit at 20%. This arrangement can also achieve the object of this invention.

Further, where three or more print head units are arranged side by side in the scan direction, print data may be allocated such that a 100% duty is divided into, from upstream to downstream, 40%, 30% and 30% or 50%, 30% and 20%.

Although the above embodiment has taken up an example construction in which a plurality of print head units each ejecting a different color ink are arranged side by side in the scan direction, this invention is also applicable to a print head construction in which the print head has a plurality of nozzle groups arranged side by side in the scan direction and allocated one with a different color ink. In this case, however, since the nozzle groups are not separable, it is not possible to set the ink volume on the upstream side greater by changing the order of the color inks as is done when a plurality of print head units are used. Therefore, the ink supply paths need to be changed.

In this invention a maximum applicable ink volume for a print medium is an important constitutional element. This is because, when an image is printed in a small number of passes, various color inks used for printing are necessarily ejected concentratedly in a short length of time. Suppose, for example, each nozzle array in a print head has nozzles arrayed at a density of 1200 dpi, each nozzles ejecting 5 pl of ink droplet, and that this ink droplet is ejected at a density of 1200 dpi also in the scan direction. If 100% solid printing is done by one nozzle group in one printing scan (pass), a print medium is required to absorb an ink volume of approximately 10 ml/m$^2$. Similarly, when 4-color full color printing is performed using four of the above print head units or nozzle groups, the print medium is required to absorb about 40 ml/m$^2$ of inks without image degradation.

In actual full color printing a 400% ink ejection over an entire surface of a print medium is not performed (as this forms a solid black over the entire page) and the maximum ink volume actually applied ranges from 200% to 300%, covering only a part of an image. The maximum applicable ink volume s determined as a design value of the printing system from the ink absorption capability of a print medium. Therefore, the maximum applicable ink volume can be defined as a volume of ink used that the print medium can absorb without any image degradation in a certain environment (operation environment of a printing system, such as temperature and humidity).

It is also possible to consider an ink volume that the printing system actually applies to a print medium when it prints at a maximum duty. In that case, the printing operation may be done by setting a print speed, or thinning out print data so as to enable the applied ink volume to be absorbed in the print medium. As for the maximum applicable ink volume, although it may be calculated based on a total volume of all color inks as described above, if the print head units of different colors are sufficiently spaced apart, a maximum ink volume used for each color may be substituted for the maximum applicable ink volume.

Also applicable to this invention is an ink jet printing apparatus which uses for each color a plurality of dark and light inks and large and small dots albeit with an increased cost. Whatever configuration may be employed, the maximum print duty can be set according to the number of print head units used, kinds of inks, a print medium used, a print speed and an ink volume to be applied.

The method employed in the above embodiments, i.e., setting at equal intervals a plurality of nozzle groups or print head units arranged side by side in the scan direction and also setting a print duty higher for a nozzle array or print head unit situated more on the upstream side in the scan direction, can also be applied to the above-described related technologies. For example, in the printing process using an elongate print head constructed of a combination of nozzle groups each made up of relatively short nozzle arrays, as shown in FIG. 12 to FIG. 15, this invention can also be applied. In the related technologies this invention can also improve the print speed while maintaining a high image quality.

Ink jet printing systems that allow a print head using the above-described nozzle arrays and nozzle groups to be realized with relative ease and at low cost include the following. It is noted that this invention is not limited to these.

This invention proves particularly effective when applied to an ink jet printing system which uses, among others, an ink jet print head that utilizes thermal energy to form flying ink droplets.

As for the typical construction and working principle of this ink jet printing system, those disclosed in U.S. Pat. Nos. 4,723,129 and 4,740,796 are preferred. This system can be applied to both the so-called on-demand type and continuous type. It is particularly suited for the on-demand type. In the on-demand type, this system applies at least one drive signal based on print data to an electrothermal transducer installed in a sheet or liquid path holding a liquid (ink) to cause it to generate a thermal energy great enough to cause a rapid temperature rise in excess of a nucleate boiling, which in turn results in film boiling on a heat application surface of a print head, generating a bubble in the ink that matches the drive signal in a one-to-one relationship. The expansion and contraction of this bubble expels a certain volume of ink from an ejection opening to form at least one flying ink droplet. Forming the drive signal in a pulse shape is also preferable as it enables the bubble to properly expand and contract instantaneously, realizing a responsive ejection of ink. Preferred pulse-shaped drive signals include those described in U.S. Pat. Nos. 4,463,359 and 4,345,262. Conditions described in U.S. Pat. No. 4,313,124, which concerns a rate of temperature rise in the heat application surface, are preferably used to for more excellent printing.

Among print head constructions based on this invention are a combined construction of nozzles, liquid paths and electrothermal transducers (linear liquid paths or right-angled liquid paths), disclosed in the patent specifications cited above, and a construction disclosed in U.S. Pat. Nos. 4,558,333 and 4,459,600 in which a heat application portion is installed in a bent area.

This invention is also effectively applied to a construction disclosed in Japanese Patent Application Laid-open No. 59-123670(1984) in which a common slit is used as an ejection portion for a plurality of electrothermal transducers and to a construction disclosed in Japanese Patent Application Laid-open No 59-138461(1984) in which an opening to absorb a pressure wave of thermal energy is made to match an ejection portion. That is, whatever construction the print head may have, this invention enables printing to be performed reliably and efficiently.

Further, this invention is particularly advantageously applied to a full-line type print head which is long enough to cover a maximum printable width on a print medium. Such a print head may be constructed by a combination of a plurality of print head units or as a single, integrally formed elongate print head.

Further, this invention is also effectively applied to serial type print heads, which include a fixed type print head secured to a printing apparatus body, a replaceable chip type print head which, when mounted to the printing apparatus body, is electrically connected with and supplied ink from the apparatus body, and a cartridge type print head which has ink tanks integrally attached thereto.

As for the construction of a printing apparatus of this invention, the addition of an ejection recovery means for a print head and a preliminary auxiliary means is desirable as they can further stabilize the effects produced by this invention. More specifically, these means include a capping means, a cleaning means and a pressurizing or suction means all for a print head, a preheating means using electrothermal transducers or other heating elements or a combination of these, and a preliminary ejection means for ejecting ink prior to printing.

EXAMPLE IMPLEMENTATIONS

Now, this invention will be described in more detail by taking up example implementations.

Implementation 1

In this Implementation 1, four of the elongate (about 4-inch long) full-line type print head units of FIG. 15 were used on the ink jet printing apparatus of FIG. 1 to perform printing using four color inks according to the printing method described in the above embodiments. Each print head unit has two nozzle arrays each of which has 4,096 nozzles arrayed at a density of 600 dpi in nearly a straight line along a direction (Y direction) perpendicular to the scan direction. In each print head unit the nozzles of the downstream nozzle array are arranged between the nozzles of the upstream nozzle array, so that, when viewed as a whole, the nozzles of the print head unit are arranged in a staggered pattern and the combination of the two nozzle arrays provides an overall density of 1200 dpi.

The electrothermal transducers (heaters) in the individual nozzles were driven to eject an ink droplet of 5.0±0.5 pl from each nozzle. As the inks containing colorants, off-the-shelf inks dedicated for BJF850 (Canon make) were used.

Photo-glossy paper (Pro-photo paper PR101 of Canon make) dedicated for ink jet printing was used as a print medium.

As for the print head and the printing method, the ink droplet ejection drive frequency was set at 8 kHz. The ink ejection volume was 5 pl/dot, which is equivalent to about 10 ml/m$^2$ if a 100% solid printing is performed. Although it is possible to perform a 400% printing in a 4-color full color, the real full color printing normally has a maximum ink ejection volume of about 200–250% after the print data has been separated into individual colors, depending on the ink, print medium and image to be printed. It is therefore necessary to arrange the nozzle arrays so as to be able to absorb about 20–25 ml/m$^2$. The following settings were used.

The ink absorption time of the print medium (PR101) as calculated by the Bristow's method is as shown in the above table. For example, when a square print matrix of 1200-dpi pixels is solid-printed (100% duty) at an ejection drive frequency of 8 kHz, 5 ml/m$^2$ of ink is absorbed in 3 msec. Similarly, 10 ml/m$^2$ of ink is absorbed in 8 msec, 15 ml/m$^2$ in 16 msec, and 20 ml/m$^2$ in 28 msec.

As for print data, input image data was separated into four colors C, M, Y, K and then binarized to generate print data for each color which has a maximum ink ejection volume of 5 ml/m$^2$ for C, 8 ml/m$^2$ for M, 5 ml/m$^2$ for K and 2 ml/m$^2$ for Y.

Then, the ink C was ejected from the print head unit 15A, K from 15B, H from 15C and Y from 15D so that an ink with a higher ink ejection volume could be ejected from a print head unit situated more on the upstream side in the scan direction. In this Implementation 1, the nozzle array distance in each print head unit was set at about 2.4 mm.

Using this print head, image data was printed in one printing scan. A high quality image without an image degradation characteristic of the 1-pass printing was produced.

Implementation 2

In this Implementation 2, a print head having eight nozzle arrays arranged as shown in FIG. 15 was used to print a single-color image such as monochrome image at a maximum ink ejection volume of 200% (i.e., 200% in areas of maximum grayscale level). Each nozzle array has the same construction as in the Implementation 1. In the Implementation 2, however, the two nozzle arrays making up one print head unit in the Implementation 1 was used as one nozzle group. So, four nozzle groups were formed in one print head. In the following description, of the two nozzle arrays making up each nozzle group, one situated on the upstream side in the scan direction is called an even-numbered array and one situated on the downstream side is called an odd-numbered array.

All of the four nozzle groups were supplied inks of the same color, e.g. a black ink. Binary print data was generated that specified whether or not individual pixels in the 1200×2400-dpi print matrix were to be printed. The print data thus generated was divided into 1200×1200-dpi print data for an even-numbered array of the print matrix and 1200×1200-dpi print data for the odd-numbered array. For each of the divided even- and odd-numbered arrays of binary print data for the print matrix, a mask was prepared to enable printing at print duties of 40%, 30%, 20% and 10%. A binary image for the even-numbered array and a binary image for the odd-numbered array were individually masked with the associated masks and supplied to the four nozzle groups. As a result, the first nozzle group printed at a print duty of 80%, the second nozzle group printed at 60%, the third nozzle group printed at 40% and the fourth nozzle group printed at 20% to form a single-color image (here, a monochrome image).

In this Implementation 2, also, an image with a satisfactory quality was obtained as in Implementation 1.

Implementation 3

A full-line type print head similar to the one used in the Implementation 1 was used. An input image to be printed was separated into four colors C, M, Y, K and then binarized to generate print data for each color which has a maximum ink ejection volume of 2 ml/m$^2$ for C, 5 ml/m$^2$ for Y, 3 ml/m$^2$ for K and 5 ml/m$^2$ for M. Then, the print head units were rearranged so that inks could be ejected in the order of M, Y, K and C beginning with the upstream side of the main scan direction. Using this print head, image data was printed in one printing scan. The printed image obtained had no image quality degradation characteristic of the 1-pass printing.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-417363 filed Dec. 15, 2003, which is hereby incorporated by reference herein.

What is claimed is:

1. An ink jet printing apparatus for forming an image on a print medium by moving a print head having a plurality of nozzle groups relative to the print medium in a scan direction as the nozzle groups eject ink from their ink ejection nozzles according to print information, the nozzle groups each having a plurality of ink ejection nozzles and being arranged side by side in the scan direction, wherein each of the nozzle groups has at least one nozzle array, the nozzle array having a plurality of nozzles arrayed in a predetermined array direction crossing the scan direction, and wherein the ink jet printing apparatus includes an ejection volume setting means which sets ink volumes applied to a unit area of the print medium by the nozzle groups in such a way that an ink volume per unit area applied by at least the nozzle group situated most upstream in the scan direction is greater than that applied by the other nozzle groups.

2. An ink jet printing apparatus according to claim 1, wherein the ejection volume setting means sets ink volumes applied to a unit area of the print medium by the nozzle groups in such a way that an ink volume per unit area applied by the nozzle group situated more upstream is greater.

3. An ink jet printing apparatus according to claim 1, wherein the ejection volume setting means has a print duty setting means which sets a print duty of each of the nozzle groups, wherein the print duty setting means sets a print duty of at least the nozzle group situated most upstream higher than those of the other nozzle groups.

4. An ink jet printing apparatus according to claim 1, wherein the ejection volume setting means comprises a thinning out means which thins out print data supplied to each of the nozzle groups, wherein the thinning out means sets a thinning out rate of print data supplied to at least the nozzle group situated most upstream less than that of print data supplied to the other nozzle groups.

5. An ink jet printing apparatus according to any one of claims 1 to 4, wherein a distance between the adjoining nozzle groups adjoining in the scan direction is determined according to a time it takes for the print medium to absorb a total ink volume applied to the print medium by the two adjoining nozzle groups at a predetermined print frequency.

6. An ink jet printing apparatus according to claim 5, wherein the absorption time is an absorption time calculated from an absorption rate measured by a Bristow's method.

7. An ink jet printing apparatus according to claim 6, wherein the inks and the print medium used have a Bristow absorption coefficient Ka (ml/m$^2$·$\sqrt{}$msec) of between 1 and 15.

8. An ink jet printing apparatus according to claim 1, wherein the plurality of nozzle groups are supplied ink from a predetermined ink supply means.

9. An ink jet printing apparatus according to claim 8, wherein the plurality of nozzle groups are supplied different inks.

10. An ink jet printing apparatus according to claim 8 or 9, wherein the ink supply means can change ink supply paths to the nozzle groups.

11. An ink jet printing apparatus according to claim 10, wherein the ink supply means comprises ink tanks provided for the associated print head units and mounting positions of the ink tanks with respect to the print head units can be changed.

12. An ink jet printing apparatus according to claim 1, wherein the plurality of nozzle groups are formed in a single print head unit.

13. An ink jet printing apparatus according to claim 1, wherein each of the nozzle groups is formed in one of a plurality of print head units.

14. An ink jet printing apparatus according to claim 13, wherein an arrangement order of the print head units in the main scan direction can be changed.

15. An ink jet printing method for forming an image on a print medium by moving a print head having a plurality of nozzle groups relative to the print medium in a scan direction as the nozzle groups eject ink from their ink ejection nozzles according to print information, the nozzle groups each having a plurality of ink ejection nozzles and being arranged side by side in the scan direction, wherein each of the nozzle groups has at least one nozzle array, the nozzle array having a plurality of nozzles arrayed in a predetermined array direction crossing the scan direction, and wherein ink volumes applied to a unit area of the print medium by the nozzle groups are set in such a way that an ink volume per unit area applied by at least the nozzle group situated most upstream in the scan direction is greater than that applied by the other nozzle groups.

* * * * *

UNITED STATES PATENT AND TRADEMARK OFFICE

CERTIFICATE OF CORRECTION

PATENT NO. : 7,083,255 B2
APPLICATION NO. : 11/008982
DATED : August 1, 2006
INVENTOR(S) : Shibata et al.

It is certified that error appears in the above-identified patent and that said Letters Patent is hereby corrected as shown below:

COLUMN 1:
Line 11, “colorant” should read --colorant.--; and
Line 32, “these” should read --this--.

COLUMN 2:
Line 32, “quality” should read --quality.--.

COLUMN 5:
Line 19, “parallel” should read --parallel- --;
Line 20, “1y” should read --ly--; and
Line 55, “heads” should read --heads.--.

COLUMN 6:
Line 48, “invention” should read --invention.--, and “In” should begin a new paragraph.

COLUMN 7:
Line 19, “In” should read --in--; and
Line 63, “image” should read --image.--.

COLUMN 8:
Line 59, “printing” should read --printing,--; and
Line 62, “quality” should read --quality.--, and “The” should begin a new paragraph.

COLUMN 10:
Line 1, “medium” should read --medium.--; and
Line 57, “example” should read --example.--.

COLUMN 11:
Line 13, “111.” should read --111--; and
Line 17, “head” should read --head.--.

COLUMN 13:
Line 58, “layer.,” should read --layer,--; and
Line 61, “measurements” should read --measurements.--.

UNITED STATES PATENT AND TRADEMARK OFFICE

CERTIFICATE OF CORRECTION

PATENT NO. : 7,083,255 B2
APPLICATION NO. : 11/008982
DATED : August 1, 2006
INVENTOR(S) : Shibata et al.

It is certified that error appears in the above-identified patent and that said Letters Patent is hereby corrected as shown below:

COLUMN 15:
Line 52, "units" should read --units.--, and "Considering" should begin a new paragraph.

COLUMN 16:
Line 43, "mm/msec" should read --mm/msec.--; and
Line 51, "regard" should read --regard to--.

COLUMN 17:
Line 9, "units" should read --units.--.

COLUMN 18:
Line 13, "22" should read --22.--.

COLUMN 19:
Line 18, "Furthers" should read --Further,--; and
Line 19, "images," should read --image,--.

COLUMN 20:
Line 9, "nozzles" should read --nozzle--; and
Line 24, "volume s" should read --volume is--.

COLUMN 21:
Line 14, "a" should be deleted.

Signed and Sealed this

First Day of July, 2008

JON W. DUDAS
*Director of the United States Patent and Trademark Office*